United States Patent [19]

Langham et al.

[11] Patent Number: 5,002,283

[45] Date of Patent: Mar. 26, 1991

[54] DEFENSIVE DRIVING QUESTION AND ANSWER GAME HAVING SEPARATE INTERCHANGE BRIDGE SECTION

[76] Inventors: Norma Langham, P.O. Box 455, California, Pa. 15419; Pauline H. Glod, Box 306, Denbo, Pa. 15429

[21] Appl. No.: 546,936

[22] Filed: Jul. 2, 1990

[51] Int. Cl.[5] ..... A63F 3/04

[52] U.S. Cl. ..... 273/252; 273/148 R; 273/283

[58] Field of Search ..... 273/246, 249, 248, 251, 273/252, 253, 254, 243, 148 R, 283

[56] References Cited

U.S. PATENT DOCUMENTS

| | | | |
|---|---|---|---|
| 2,163,011 | 6/1939 | Schaub | 273/252 |
| 2,239,779 | 4/1941 | Clark et al. | 273/254 |
| 3,099,451 | 7/1963 | Newhouse | 273/253 |
| 3,924,858 | 12/1975 | Dittrich et al. | 273/254 |
| 4,323,249 | 4/1982 | Brady | 273/249 |

FOREIGN PATENT DOCUMENTS

| | | | |
|---|---|---|---|
| 2038192 | 7/1980 | United Kingdom | 273/243 |

*Primary Examiner*—Benjamin Layno

*Attorney, Agent, or Firm*—William J. Ruano

[57] ABSTRACT

A structured game in which players move vehicles through traffic lanes and interchanges on a main playing board from a starting point of a home base to a finishing point in the same home base, and in a variation played on a secondary board, being the reverse side or cover of the main playing board, in which the players move vehicles through a path of states on a map of the United States from a starting point of one state to a finishing point of another state. The game is called "DD, DEFENSIVE DRIVING GAME OF CARS" because if one learns to handle himself and his vehicle effectively in a regular or in an emergency driving situation, he can defend himself and others from his own possible errors and from the errors of others and because calling out "DD!" in the game requires the quick, accurate reaction necessary for safe driving. The players must obey traffic regulations, such as going the right way, maintaining a safe speed, and not hitting other vehicles. Direction of movement is determined by two different methods, being the beginners' method of throwing a cube and the advanced players' method of answering traffic-situations questions.

4 Claims, 13 Drawing Sheets

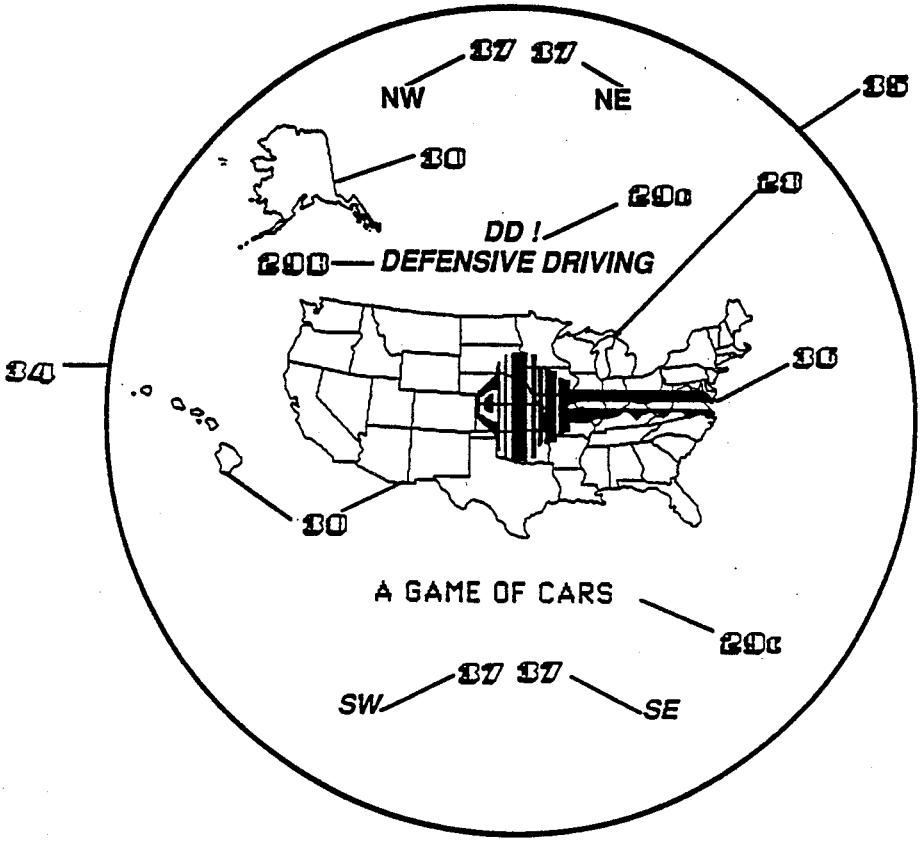
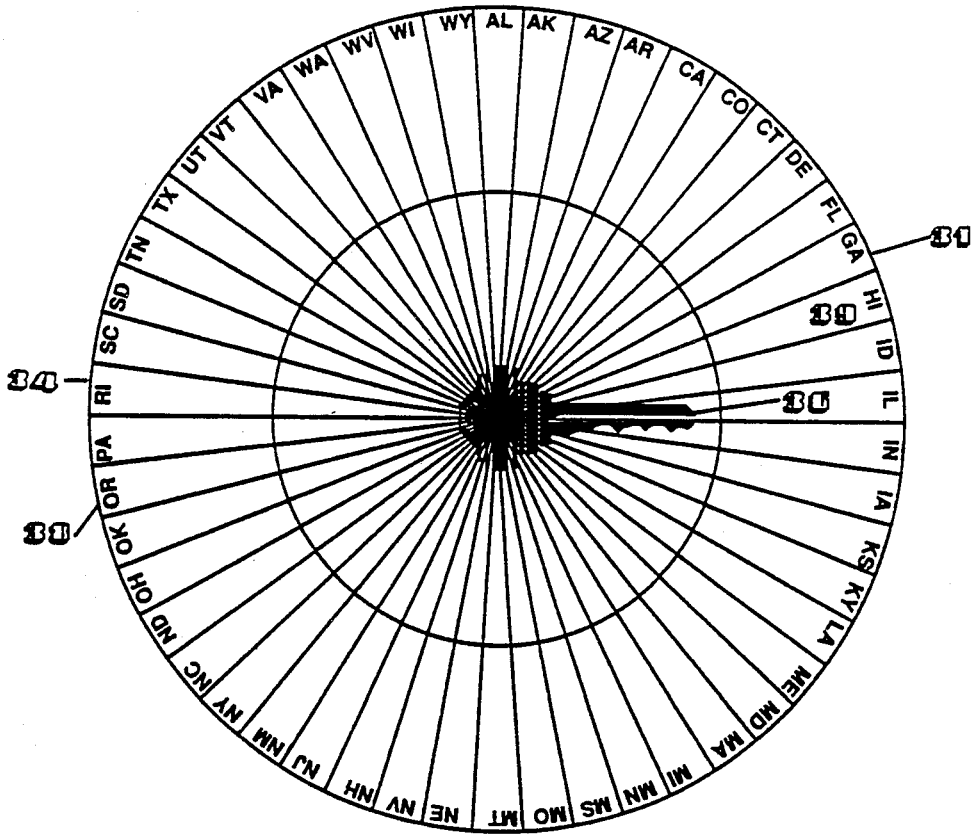
FIG. 7

SE-2 Route:

Leave Southeast Home. Go north on East Coast Highway, U.S. Route 1. Turn left.
Go west on Northern Border Highway, U.S. 30. Turn left.
Go south on West Coast Highway, U.S. 101, to Interstate Entrance.
Enter Interstate Highway. Go to Exit.
Exit onto East Coast Highway, U.S.1.
Make a U-turn and re-enter Interstate. Go to Exit.
Exit on West Coast Highway, U.S. 101. Turn left.
Go south on West Coast Highway, U.S. 101. Turn left.
Go east on Southern Border Highway, U.S. 10, to Southeast Home.

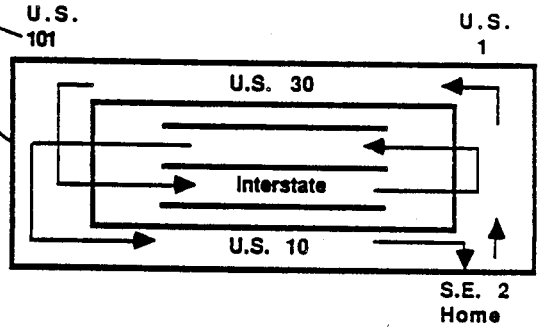

DEFENSIVE DRIVER LICENSE #DD-SE-2

This license grants the privilege of driving a vehicle on U.S. Routes and on Interstate Expressways of the Defensive Driving Board.

DEFENSIVE DRIVING INSURANCE POLICY

For Defensive Driver DD-SE-2

The driver acknowledges responsibility to passengers, pedestrians, and other drivers of any type of vehicle and to their passengers and promises to drive with good will and with concern for the safety of all.

FIG. 14

DEFENSIVE DRIVING QUESTION AND ANSWER GAME HAVING SEPARATE INTERCHANGE BRIDGE SECTION

This application is related to a parent application Ser. No. 07/135,847 filed Dec. 21, 1987 and abandoned on Nov. 3, 1989.

This invention relates to a game of cars relating to defensive driving, which is defined as driving to prevent accidents.

BACKGROUND OF THE INVENTION

Games played by cars are known but do not involve education on defensive driving as in the present invention in its comprehensiveness and uniqueness.

In 1958, Norma Langham first began to develop the game as a traffic cards game without a board and, therefore, developed a set of traffic questions and answers on three-by five-inch cards. In 1986, she returned to developing the game, this time with a game board. In 1987, Pauline Glod joined her, both being, then, emeriti college professors, to invent "DD!, Defensive Driving Game of Cars" by pooling their expertise in education, in developing creativity in children and in college students, and in children's dramatics and theatre, along with their years in driving, in order to contribute to reducing the terrible toll of traffic accidents by a game which will entertain and inform children, teenagers, and adults, including senior citizens. They researched the driving manuals of all fifty states of the United States for a comprehensive coverage of every driving situation. Realizing that the traffic-situations-questions may be too difficult at first for little children and for the beginning player, but still wanting to get them started with the game, the inventors chose to create two easy forms of the game to be played with a cube or die, one form for little children and one form for older beginners, in addition to the form played with the traffic-situations questions. The children's game is to be played on driving pathways on the cover of the main game board. The beginners' form and the advanced questions-and-answers form are to be played on the main game board pathways. The inventors used the art principles of painting and of stage design to make the game apparatus colorful and aesthetically pleasing, and the stage principles of movement and directing to make the playing exciting. Besides solutions to problems of traffic situations involving traffic-laws driving skills, and defensive driving techniques, geographic locations across the United States add to knowledge and to interest. In addition, the player learns to follow maps and routes in a simulated trip across the United States and to handle his car according to traffic laws and good driving practices.

SUMMARY OF THE INVENTION

The Value of the Game

The value of the game lies in its entertainment and its education for highway safety. If even one life is saved by the knowledge gained, the game's value is beyond measure. The game instills safety practices in children, as bicyclists, pedestrians, and car passengers, while their interest in driving preparation is high, even though they are not yet old enough to drive cars or motorcycles. Through the game, children learn about driving while they are eager to learn and to contribute to family safety and traffic awareness. On a car trip, the family can play the game without the board but with the cards of the traffic-situations questions and answers. Teenagers and other prospective drivers can play the game as personal study for driving-license tests and as participation in driver-training courses. Non-drivers can learn what to do in emergencies, such as being in a car immersed in water, and also ways to contribute to safety as a passenger or pedestrian. Experienced drivers can learn to improve their driving skills from the differing ideas of the fifty state driving manuals, since some state manuals contribute ideas other state manuals omit. For driving in different states, drivers learn what laws are standard to all states and what are particular to certain states. Players have fun in sharing the game at home with the family, at a party with friends, at school in driver-training groups, at clubs, and at senior citizen centers.

Concept of the Game

"DD!, Defensive Driving Game of Cars" in the beginners' and advanced players' forms is a structured game in which players move vehicles through traffic lanes on a main playing board which represents the mainland United States, from a starting point of a home base to a finishing point in the same home base. Two home bases are on each of the four corners of the rectangular board, providing for different directions of movement by the car-playing-pieces. The object of these forms of the game is to make a round trip on the central pathway, named "Interstate Highway," going through at least one interchange, and on the outer pathway, named the "U.S. Routes Highway," and to return to one's home base. After a player becomes a winner by arriving home first, all others who arrive home in the same round of play are also winners. The game is titled "DD!, Defensive Driving" being "DD!" for quick reaction and "Defensive Driving" for driving to prevent accidents, because if one learns to handle himself and his vehicle effectively in a regular or in an emergency driving situation, he can defend himself and others from his own possible errors and from the errors of others. The drivers must obey traffic regulations, such as stopping at stop signs, keeping in the proper lane, and not crossing solid yellow lines. Direction of movement is determined by individual route cards. Movement of the car-playing-pieces is determined by chance, with a cube, for the beginners' form of the game; and by skill, with a traffic-situations question and answer, for the advanced form of the game.

"DD! Defensive Driving Game of Cars" in the form of the game to be played on the cover of the main game board by very little children is a structured game in which players move vehicles through states on the map of the United States. Movement of the car-playing-pieces is determined by chance with the cube. Direction of movement is determined by spinning a wheel containing the names of the fifty states of the United States to get the name of the state of one's destination. The object of this form of the game is to travel to a state to pick up the starred disk which has been placed there. The winner is the player who collects the most disks. Players must observe safe driving practices.

The three forms of the game use the same equipment of the cars, the cube and container, the spinner, the stands, the pennants, the driver's license, and the insurance card and require basic driving rules of manipulating the cars safely.

All details necessary for the structured game to function may be in the forms of three-dimensional board apparatus, books, computer discs, television, or video or audio casettes. For example, the traffic-situations questions and answers may be on cards, in programmed learning books, on computer discs, on a television program, or on video or audio cassettes.

BRIEF DESCRIPTION OF THE DRAWINGS

FIG. 1 is a plan view of the left longitudinal section of the said whole United States Cross Country Highway simulated-map-route playing board, representing western United States with its northern and southern borders and west coast.

FIG. 2 is a plan view of the middle longitudinal section of the said whole United States Cross Country Highway simulated-map-route playing board, representing mid-western United States with its northern and southern borders.

FIG. 3 is a plan view of the right longitudinal section of the said whole United States Cross Country Highway simulated-map-route playing board, representing eastern United States with its northern and southern borders and east coast.

FIG. 7 is a plan view of the spinner, which is a flat-surfaced circle, ten inches in diameter, with the obverse side used in both the beginners' and the advanced forms of the game to designate each player's home base, which said home base identifies which car-playing-piece he is to use and which, also, determines his order of play; and with the reverse side used in the children's form of the game to designate the individual state of the United States to which the player travels.

FIG. 14 shows the three cards to be held by each player while moving the car-playing-piece: the route card, the driver's license card, and the insurance policy card.

DESCRIPTION OF THE PREFERRED EMBODIMENTS

Preferred Embodiments are described in details, as follows. Said preferred embodiments are listed briefly on pages 24 through 27 as a convenient reference to the drawings by a person examining the methods of playing the game, which methods are on pages 27 through 46. Said Preferred Embodiments are identified by shadowed numerals on the drawings and by underlined numerals throughout the descriptions.

Figure 1:
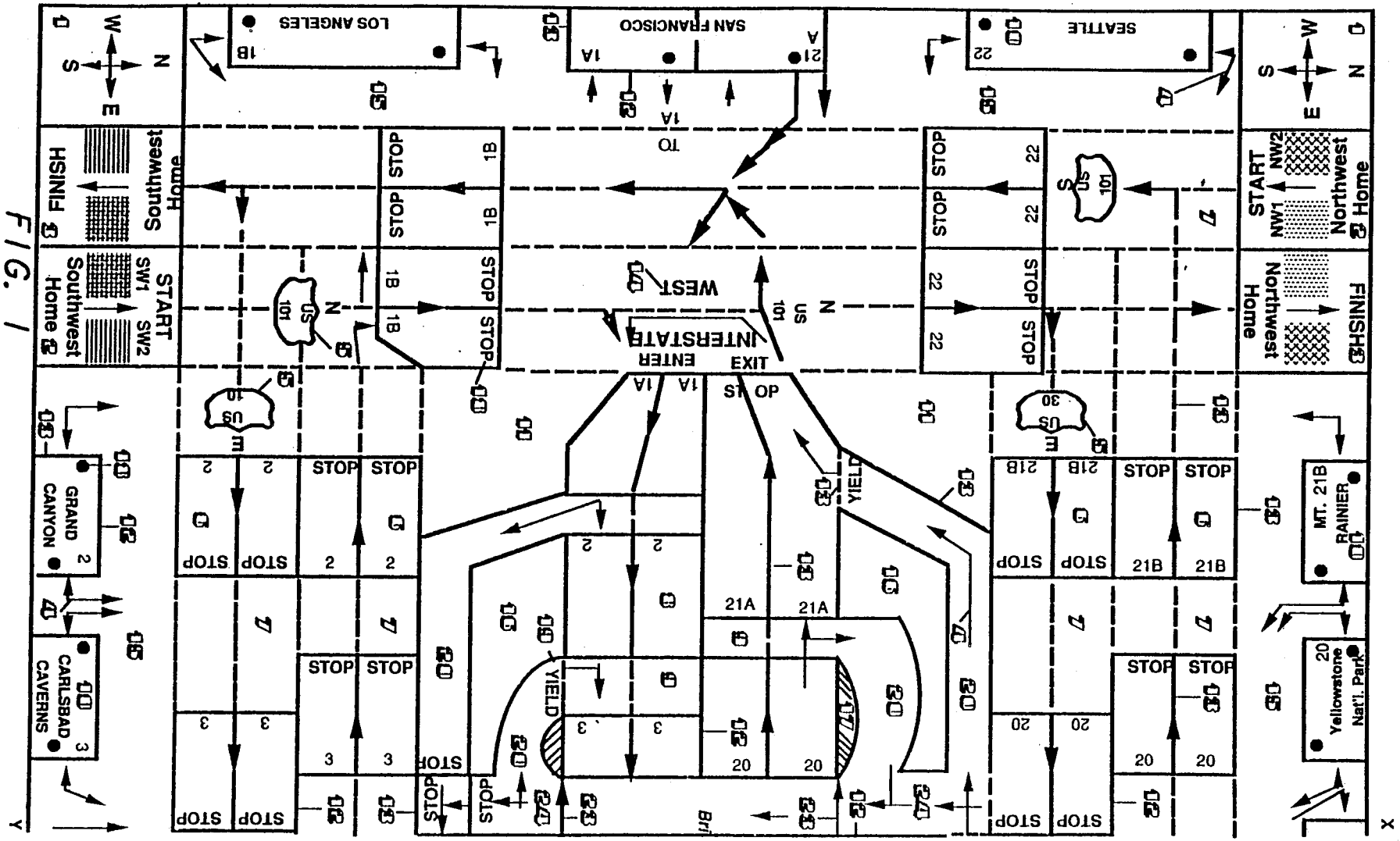
FIGS. 1, 2, and 3, when put together, the show main game board of the present invention, for the playing of the game, in a plan view of the surface of the preferred embodiment of the United States Cross Country Highway Game Board, representing the entire areas of the mainland of the United States, with the northern border, east coast, southern border, and west coast in a simulated map route. This said game board comes in three sizes to accomodate different numbers of players, the said three sizes being identical in all aspects but size. The said sizes are 11 inches by 20¾ inches for 1 to 2 players, the actual size of the drawings herein; 16½ inches by 31⅛ inches for 2 to 6 players, 1½ times the size of the drawings herein, scale being 1 inch equals 1½ inches; 33 inches by 62¼ inches for up to 16 players, 3 times the size of the drawings herein, scale being 1 inch equals 3 inches. Each board folds for ease of handling.
Figure 2:
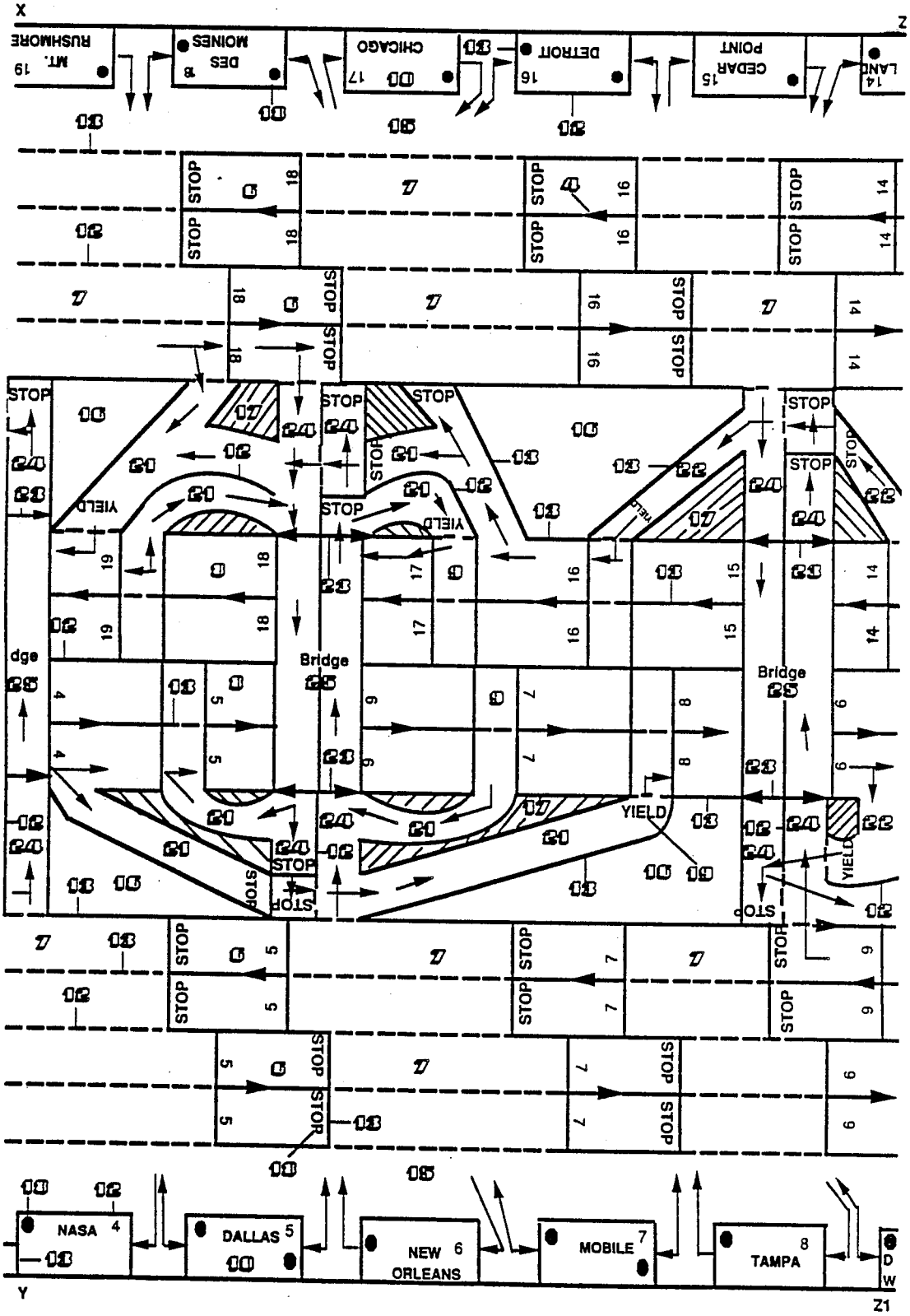
Figure 3:
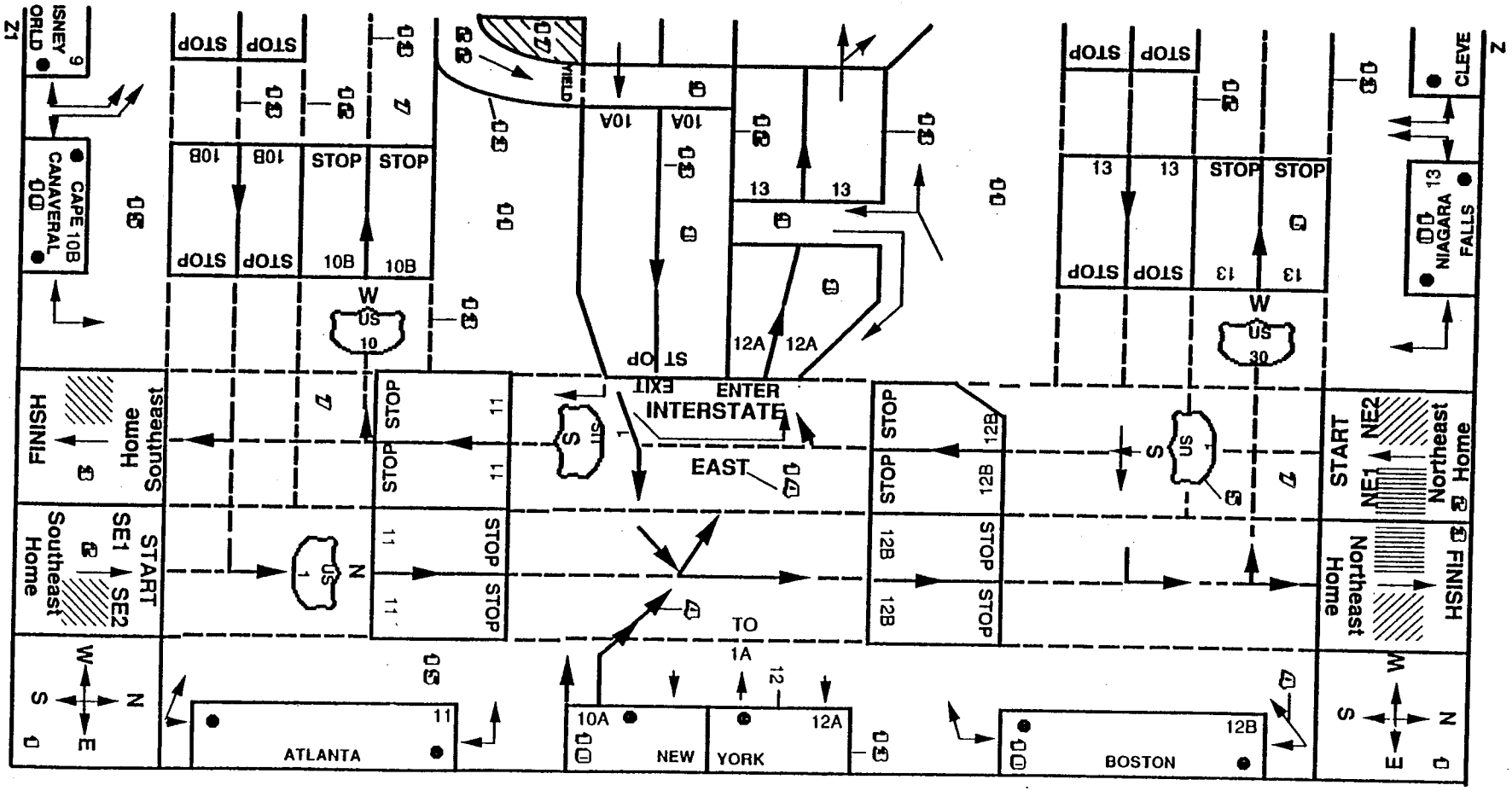
Figure 4:
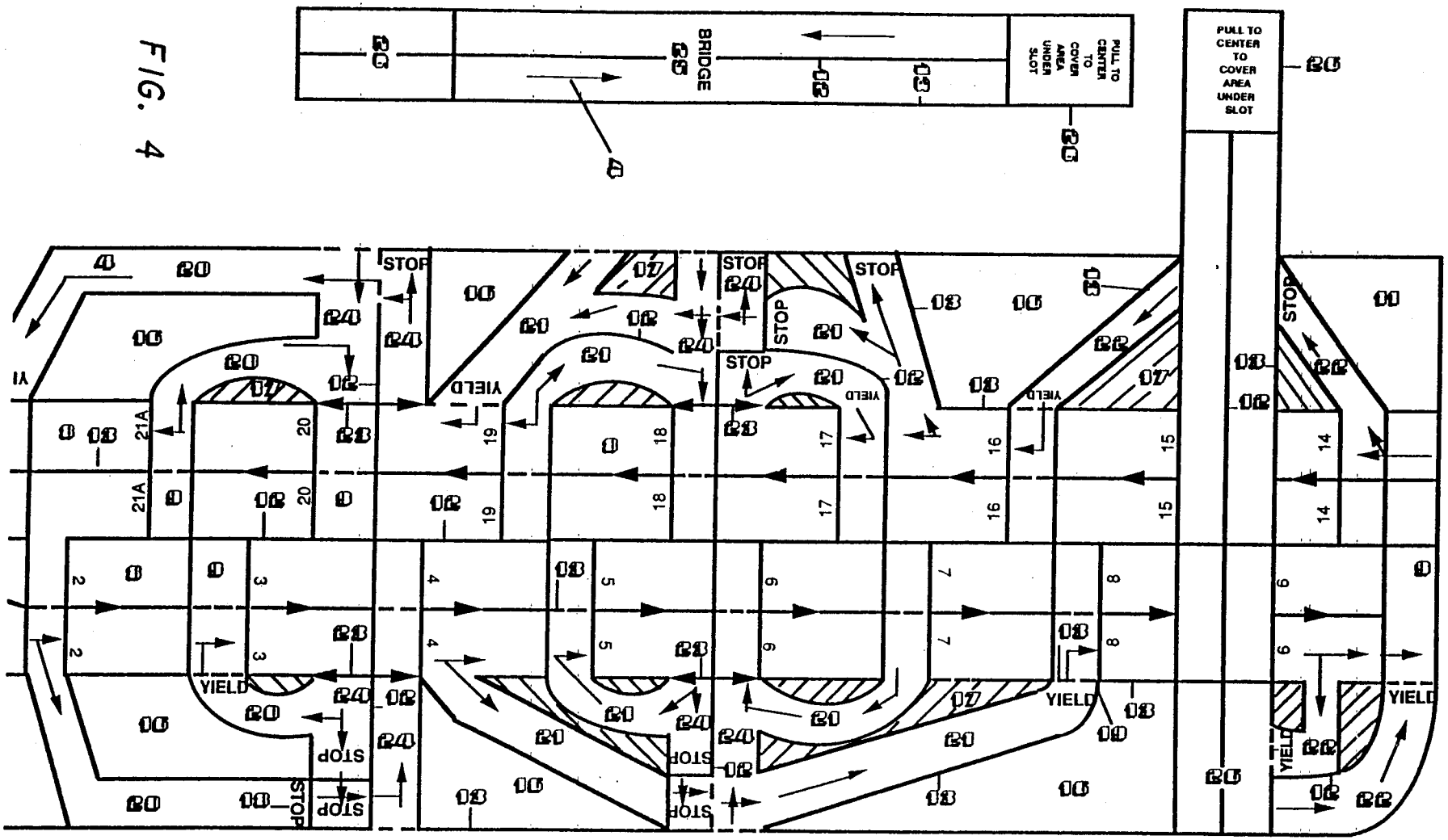
FIG. 4 has two plan views, one plan view being the double-lane bridge, three of which go over the three interchanges on the Interstate Highway, which said highway is the central pathway of FIGS. 1, 2, and 3, the three bridges being shown on FIGS. 1, 2, and 3; the other plan view being a section of said Interstate Highway, showing the placing of one said bridge by displaying the full length of the bridge before the ends are placed under the slots which hold the said bridge in a three-dimensional curve, and, also, said plan view of the said Interstate Highway showing sections of the said Interstate Highway hidden by the other two bridges on FIGS. 1 and 2.

FIG. 1, being a left portion, FIG. 2, being a central portion, and FIG. 3, being a right portion, of the U.S. Cross Country Highway Game Board are joined together at x-x, y-y, z-z-, and zl-zl to make the entire length of the game board. FIG. 4 shows the bridge, the method of fastening each bridge to the Interstate Highway of the entire game board of FIGS. 1, 2, and 3, and, also, sections of the said Interstate Highway hidden by two of the bridges on FIGS. 1 and 2. The said Interstate Highway with its interchanges and bridges can be a detachable piece to be placed on the main game board over a permanent same said Interstate Highway without the said interchanges and bridges.

The preferred embodiments of FIGS. 1, 2, 3, and 4 are identified by the following numerals, being shadowed numerals on the drawings and being underlined numerals in the descriptions hereinafter:

1 is the COMPASS POINT, one of four, being NE for Northeast, SE for Southeast, SW for Southwest, and NW for Northwest, each placed in the appropriate geographic area of the four corners of the said rectangular board, as on a map. The crossed arrows, within each square, point to the geographic-letter symbols closest to the adjacent border and coast of the said simulated United States map of the said main game board and thus indicate the said compass point, such as SW for the Southwest area. See FIGS. 1 and 3.

Figure 6:
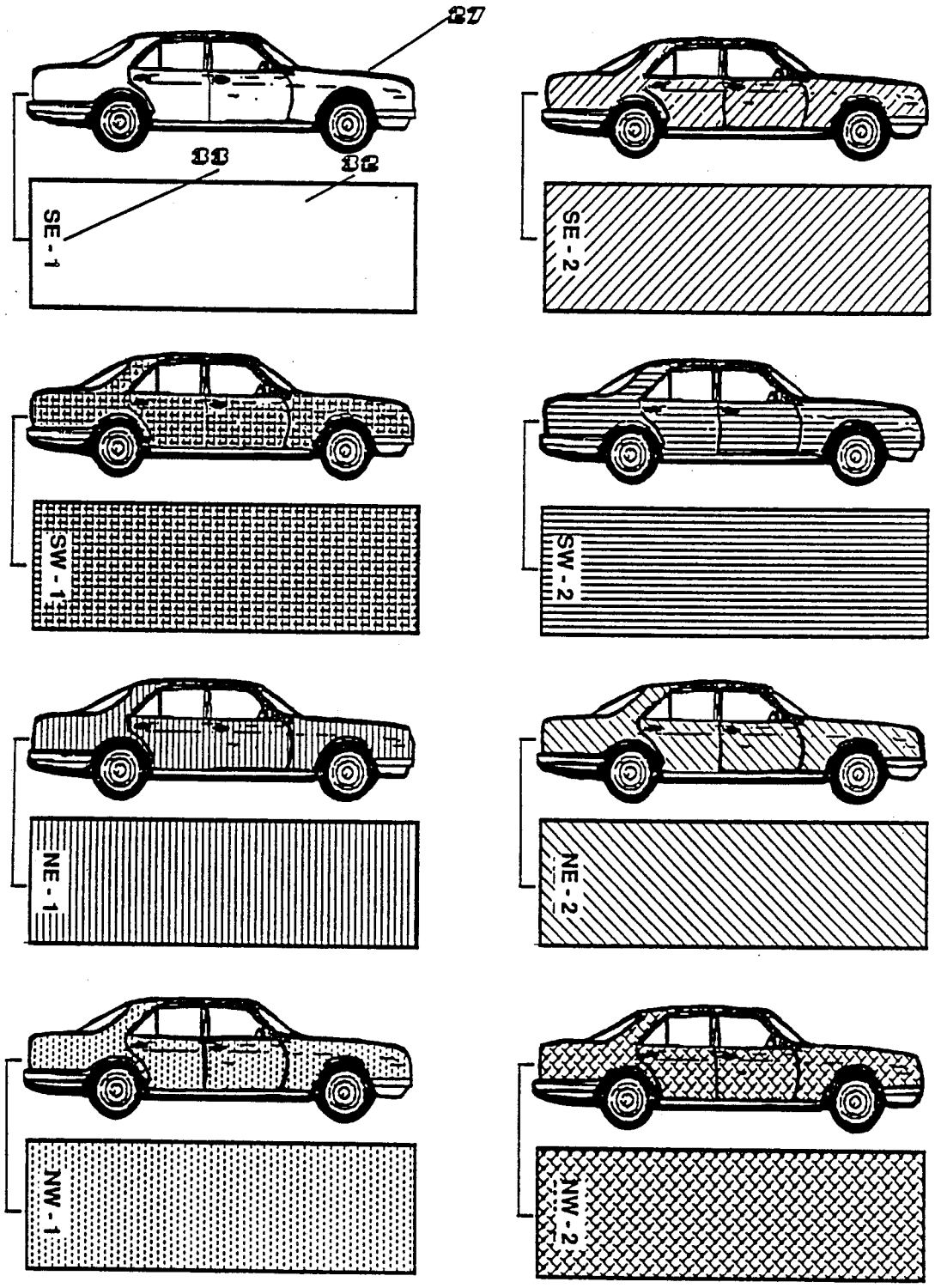
FIG. 6 shows two views of each of the eight car-playing pieces used as the objects to be moved on the game board: a side pictorial view and, also, a plan view of the top and bottom surface, each car identified by its individual license number and color, the said colors denoted by conventional color symbols.

2 is the Home BASE STARTING POINT, one of four, being identified as Northwest Home, Southwest Home, Northeast Home, and Southeast Home, each one located nearby the appropriate said compass point, 1, in the said appropriate geographic corner of the said simulated map of the said game board, and also being identified by the word "START." Each said base, as for example Southwest Home, is divided into two areas, for example SW1 and SW2, to give a starting home base in the example area of the Southwest, for the two said car-playing-pieces of FIG. 6, each using, for example, SW1 or SW2 exclusively as its individual identifying license and starting area. Each said home base division is further identified in that its color matches the color of the said car-playing-piece that is to begin from that division of the said home base, thus helping the player in locating his said home base. The said color is identified by conventional color symbols. See FIGS. 1, 3, and 6.

3 is the HOME BASE FINISHING POINT, one of four, being on FIG. 1 and 3 as Northwest Home, Southwest Home, Northeast Home, and Southeast Home, each one being adjacent to the corresponding said Home Base Starting Point of the same said geographic area, 2, in each said geographic corner of the said simulated map of the said game board. Each said Home Base Finishing Point is also identified by the word "FINISH." Each said Home Base Finishing Point is divided into two areas identified by color to match the color of the said car-playing-piece that is to finish at that said home base, thus helping the player in locating his home base. The said color is identified by conventional color symbols.

4 is a DIRECTIONAL ARROW, one of a plurality of said arrows, to guide the direction of movement of the said car-playing pieces, FIG. 6, on the pathways, below described, 6, 7, 8, 9, 11, 15, 20, 21, 22, 24, and 25 of the said game board. See FIG. 1, 2, 3, and 4.

5 is a U.S. ROUTE SIGN, one of a plurality of said U.S. Route signs to designate U.S. Route 1, going north and south along the east coast of the said game board; U.S. Route 10, going east and west along the southern border of the said game board; U.S. Route 101 going north and south along the west coast of the said game board; and U.S. Route 30 going east and west along the northern border of the said game board, all geographic areas being identified by the said compass points, 1. See FIG. 1 and 3.

6 is a U.S. ROUTE COLORED ROAD SECTION, one segment of a series of said colored road sections, which together with the U.S. Route grey road sections 7, each said grey road section lying between each two said colored road sections, make the pathway of the traffic lanes of the U.S. Route 1, 10, 30, and 101, each said pathway being identified by the said U.S. Route sign 5, above, the said pathway encircling the board and connecting the said U.S. Routes to the said home bases, 2 and 3. Each colored road section is identified by having an individual permanent number, not shadowed, on the section. The said traffic lanes of the said colored and said grey road sections are marked by solid and broken yellow and white lines, below described, 12 and 13. The said yellow lines, 12, separate the two lanes going in one direction and the two lanes going in the opposite direction. The said white lines, 13, both separate the said two lanes going in the same direction and mark the outside edge of said lanes. Each colored road section indicates the area for one move if moves are counted by colored road sections, or it designates the final area on which the player must stop if moves are allotted by seconds of time. Each said colored road section of each traffic lane has the word "STOP" at its end in the direction of traffic movement, said movement indicated by a said arrow, 4. Said word "STOP" indicates a stop sign, below described, 18. The said colored road sections are related by permanent number to the geographic places, cities, resorts, and parks, below described, 10, on the edges of the said main game board. The particular color of each road section does not matter as long as it is the same as the color of the related geographic place, 10, both areas being identified by having the same permanent number, unshadowed, on the board; as long as it differs in color from nearby U.S. Route colored road sections, and as long as the color is bright, not grey, and is arranged in artistic balance of color. For this reason, and, also, to avoid cluttering the drawings of FIGS. 1, 2, 3, and 4, such colors are not identified by conventional color symbols. See FIGS. 1, 2, and 3.

7 is a U.S. ROUTE GREY ROAD SECTION, one section of a series of such grey road sections of the U.S. Route traffic lanes, which said each grey road section lies between each two colored-road-sections, 6 above, of the U.S. Route, which together with said colored road sections make up the traffic lanes of the U.S. Routes 1, 10, 30, and 101, marked by the said route signs, 5 above. The purpose of the grey area separating the colored road sections is to make the said area, described above, 6, for one move, if moves are counted by section, or the final area on which the player must stop, if moves are allotted by seconds of time. These said traffic lanes of the grey and colored road sections are marked by said solid and broken yellow and white lines, described above, 6, the yellow lines, described below, 12, separating the lanes going in the opposite direction, and the white lines, described below, 13, both separating each two lanes going in the same direction and marking the outside edge of said lanes. See FIGS. 1, 2, and 3. To avoid cluttering these said drawings, these said grey road sections, and all grey road sections of 9, 11, and 15, below, are not identified by conventional color symbols but are identified either by being between or by being parallel to the colored road sections, each said colored road section marked by a permanent, not shadowed, number.

8 is an INTERSTATE HIGHWAY COLORED ROAD SECTION, one section of a series of such colored road sections, which together with the Interstate Highway grey road sections 9, described below, lying between every two of the said colored road sections, thus separating them, make up a central pathway of traffic lanes called the Interstate Highway, extending from U.S. Route 1 on the east coast of said main game board to U.S. Route 101 on the west coast of the said main game board, all geographic areas being identified by the said compass points, 1 above, on each of the four corners, and both said routes being identified by the said route signs, 5 above. Each Interstate Highway colored road section is identified by having an individual permanent number, not shadowed, on the section. The said colored road sections together with the said linking grey sections make up traffic lanes divided by a solid yellow line, described below, 12, separating the lanes going in the opposite direction; and by solid and broken white lines, described below, 13, separating the lanes going in the same direction, and, also, marking the outer edge of the said Interstate Highway pathway. As in the U.S. Routes pathways, 6 and 7 above, each colored road section indicates the area for one move, if such moves are counted by colored road sections, or the said section indicates the final area on which the player must stop, if such moves are allotted by seconds of time. Only at the end of each exit road section, below 14, in the direction of traffic movement, said movement indicated by said arrows, 4 above, one exit being at the west end and the other exit being at the east end of the said Interstate Highway pathway, is the word "Stop." Said word "Stop" indicates a stop sign, described below, 18. The permanent, non-shadowed, number, identifying each Interstate Highway colored road section as a separate and individual section, matches the permanent number of the related geographic place, city, resort, or park, 10, described below, on the edge of the said main game board. As in the U.S. Routes pathway, 6 and 7 above, the particular color of each road section does not matter as long as it is the same as the color of the related geographic place, 10 below, which said geographic place also being identified by having the same permanent number, unshadowed, on the board; as long as it differs in color from nearby Interstate Highway colored road sections; and as long as the color is bright, not grey, and is arranged in artistic balance of color. For this reason, and, also, to avoid cluttering the drawings of FIGS. 1, 2, 3, and 4, such colors are not identified by conventional color symbols.

Note: On FIGS. 1, 2, and 3, the areas of the Interstate hidden by the three bridges, 25, are a continuation of the colored road sections, 8, and the grey road sections, 9, of the Interstate Highway, going horizontally across the drawings. All colored road sections, being one inch in length on the drawings, are shown by number, even though the entire oneinch length of some are partly hidden by the bridges. The grey road sections between the colored road sections are one-half inch in length on the drawings. On FIG. 4, most of the colored road sections are shown in entirety because two of the bridges hiding parts of some said sections on FIGS. 1 and 2 are not shown on FIG. 4.

9 is an INTERSTATE HIGHWAY GREY ROAD SECTION, one segment of a series of such grey road sections of the Interstate Highway traffic lanes, which said grey section lies between each two of the Interstate Highway colored road sections, described above, 8, which grey road sections together with the said Interstate Highway colored road sections make up the traffic lanes of the central pathway called the Interstate Highway. As in the U.S. Routes grey road section, described above, 7, the purpose of the grey area separating the colored road sections is to make the said colored road sections, described above, 8, either the space for one move, if such moves are counted by seconds, or the final area on which the player must stop, if such moves are allotted by seconds of time. These said traffic lanes of the grey and colored road sections, as described in 8 above, are divided at center by a solid yellow line, described below, 12, separating the lanes going in the opposite direction. Said lanes are also marked by solid and broken white lines separating the lanes going in the same direction and, also, designating the outer edge of the said pathway, 13. See FIGS. 1, 2, 3, and 4. To avoid cluttering these said drawings, these said grey road sections are not identified by conventional color symbols but are identified by being between the colored road sections, each said colored road section marked by a permanent, not shadowed, number.

10 is a GEOGRAPHIC PLACE, CITY, RESORT, OR PARK, one of a plurality, geographically located by the said compass points, above 1, from north to south on the eastern and western edges of the said main board and from west to east across the northern and the southern edges of the said game board. The said Geographic Places are related by permanent number to the said U.S. Route colored road sections, 6, and the said Interstate Highway colored road sections, 8. The particular color does not matter as long as it is the same as that on the road section of the same permanent, not shadowed, number. For this reason and to avoid cluttering the board, the color is not indicated by conventional color symbols. Each said Geographic Place has one or more said directional arrows, 4 above, nearby in the grey area, 15, described below, which said arrows point to the proper entrance and out of the proper exit of the said Geographic Place. At the said entrance or exit, each said Geographic Place has one or more white lines, 13 below, one or two yellow lines, 12 below, and one or two red octagonalshaped stop signs, 18 below. See FIGS. 1, 2, and 3.

11 is a GREY ROAD AREA BETWEEN THE INTERSTATE HIGHWAY AND THE U.S. ROUTES where a player can enter and exit his vehicle at the grey road section of the said Interstate Highway pathway, 9, FIG. 3, above, and also a grey road area adjacent to the U.S. Routes, FIG. 1 and 3. To avoid cluttering these said drawings, these grey road areas are not identified by conventional color symbols but are identified by being between the Interstate Highway and the U.S. Routes at the eastern and western edges of the Interstate Highway.

12 is a YELLOW LINE, BROKEN OR SOLID, ON THE ROAD, appearing on the said Interstate Highway pathway, 8 and 9 above; on the said U.S. Routes pathway, 6 and 7 above; on the edges of the said Geographic Places, 10, above; on the interchange ramps, described below, 20, 21, and 22; on the interchange bridges, described below, 25, and on the roads leading to the bridges, described below, 24, As described above, 8, page 9, on the said Interstate Highway pathway, the solid yellow line divides the four lanes into two lanes going west and two lanes going east. As described above, 6, page 7, on the said U.S. Routes pathway, the continuous yellow line with broken and solid sections also divides the four lanes into two lanes going west and two lanes going east. As described below, 20, 21, 22, and 24, on the said bridges of the said interchanges and on adjacent lanes of the said ramps, the solid yellow line divides the lanes. As described in 10 above, on the said Geographic Places, the solid yellow line occurs on the longest boundary. In all places, the said solid yellow line designates that said line may not be crossed by the said car-playing piece of FIG. 6. In the grey road sections, 7, of the said U.S. Routes pathway and on the said area leading to and from the said bridges, 24, the broken yellow lines may be crossed by the said car-playing piece. See FIGS. 1, 2, 3, and 4.

13 is a WHITE LINE, BROKEN OR SOLID, ON THE ROAD, appearing on the said Interstate Highway pathway 8 and 9 above; on the said U.S. Routes pathway, 6 and 7 above; on the short-side boundaries of the said Geographic Places, 10 above; on the Interstate ramps, described below, 20, 21, and 22; on the interchange bridges, described below, 25; and on the roads leading to and from the bridges, described below, 24. As described above, on both the said U.S. Routes pathway, 6 and 7, and on the said Interstate Highway pathway, 8 and 9, a continuous white line in broken and solid sections divides both the two lanes going west and the two lanes going east. All said geographic areas are according to said compass points, 1 above. The said broken white line on both said pathways designates that the said line may be crossed by the said car-playing-piece of FIG. 6. Said solid white line on both said pathways channels traffic and designates that the said line may not be crossed by the said car-playing-piece. The solid white line on the outer edge of the said U.S. Routes colored road sections, 6; and of the said Interstate Highway colored road sections, 8; and on the said interchange ramps, 20, 21, and 22, bridges, 25, and roads leading to and from the bridges, 24, designate the outer edges of the road of each said pathway, said line not to be crossed by the said car-playing-piece of FIG. 6. The solid white lines on the said Geographic Places, 10, designate entrances and exits and are lines to be crossed. The broken white lines in all places indicate areas which may be crossed. See FIGS. 1, 2, 3, and 4.

14 is an INTERSTATE HIGHWAY ENTRANCE AND EXIT, indicated by the words "INTERSTATE," "ENTER," and "EXIT" and by said directional arrows, 4 above, one entrance and exit being on the west coast at said U.S. Route 101, the place being indicated by the word "WEST," and the other entrance and exit being on the east coast of said U.S. Route 1, the place indicated by the word "EAST." Both said U.S. Routes are marked by the shadowed numeral 5, and both said geographic areas are placed according to said compass points, 1 above. See FIGS. 1 and 3.

15 is the GREY ROAD AREA FOR ENTERING AND LEAVING THE GEOGRAPHIC PLACES. This said grey area makes a division between each said Geographic Place, 10, and provides an entrance and exit area to each said Geographic Place. See FIGS. 1, 2, and 3. To avoid cluttering these said drawings, these grey road areas are not identified by conventional color symbols but are identified by being between the said U.S. Routes pathway, 6 and 7, above, and the said Geographic Places, 10 above.

16 is a GRASSY AREA, which may be painted light green. It is indicated by being between Folded Diamond Interchange Ramp, 20, and the Interstate Highway pathway, 8 and 9, of FIGS. 1 and 4, and by being between the Cloverleaf Interchange Ramp, 21, and the U.S. Routes Pathway, 6 and 7, of FIGS. 2 and 4.

17 is a BARRIER OF BLACK DIAGONAL STRIPES on a white area, where no vehicle may travel. Instead of black on white, it may be white stripes on grey. See FIGS. 1, 2, 3, and 4.

18 is a STOP SIGN, designated either by the word "STOP" or by a red octagon or circle, adjacent to a solid white line, 13 above; on the U.S. Routes pathway, 6 and 7; at the western and eastern exits of the Interstate pathway, 8 and 9; at the exits of the Geographic Places, 10; on Interchange ramps, 20, 21, and 22; and on the roads entering and exiting the Interchange bridges, 24. See FIGS. 1, 2, 3, and 4.

19 is a YIELD SIGN, designated by the word "YIELD," which is against a broken white line, 13, on the pathway. It is indicated by being between the Folded Diamond Interchange ramp, 20, and the Interstate pathway, 8 and 9; between the Cloverleaf ramp, 21, and the Interstate pathway 8 and 9; and between the Trumpet ramp, 22 and the Interstate pathway, 8 and 9, and also said ramp and the bridge road, 24. See FIGS. 1, 2, 3, and 4.

20 is a FOLDED DIAMOND INTERCHANGE RAMP, being a grey pathway with solid white lines, 13 above, on either edge, and with directional arrows, 4 above. See FIGS. 1 and 4.

Note: To avoid cluttering the drawings, the grey pathways of the Folded Diamond Interchange Ramp, 20, the Cloverleaf Interchange Ramp, 21, the Trumpet Interchanged Ramp, 22, the Bridge Entrance and Exit Roads, 23, and the Bridges, 25 are indicated by their shadowed numbers and not by conventional color symbols.

21 is a CLOVERLEAF INTERCHANGE RAMP, being a grey pathway with solid white lines, 13 above, on either edge, and with directional arrows, 4 above. Adjacent lanes are separated by solid yellow lines, 12 above. See FIGS. 2 and 4.

22 is a TRUMPET INTERCHANGE RAMP, being a grey pathway with solid white lines, 13 above, on either edge, and with directional arrows, 4 above. Adjacent lanes are separated by solid yellow lines, 12 above. See FIGS. 2, 3, and 4.

23 is the SLOTTED AREA FOR BRIDGE FASTENING into which the ends, 26 described below, of the bridge can be inserted, thus giving the bridge the three-dimensional curve, and being indicated by two arrows joined by a line. See FIGS. 1, 2, and 4.

24 is the BRIDGE ENTRANCE AND EXIT ROAD. See FIGS. 1, 2, and 4.

25 is the BRIDGE of FIG. 4, being three bridges which go over the said Interstate Highway of FIGS. 1, 2, 3, and 4.

26 is BRIDGE AREA COVERED UNDER SLOT, when bridge is pulled up into place, shown only on FIG. 4.

FIG. 5

Figure 5:
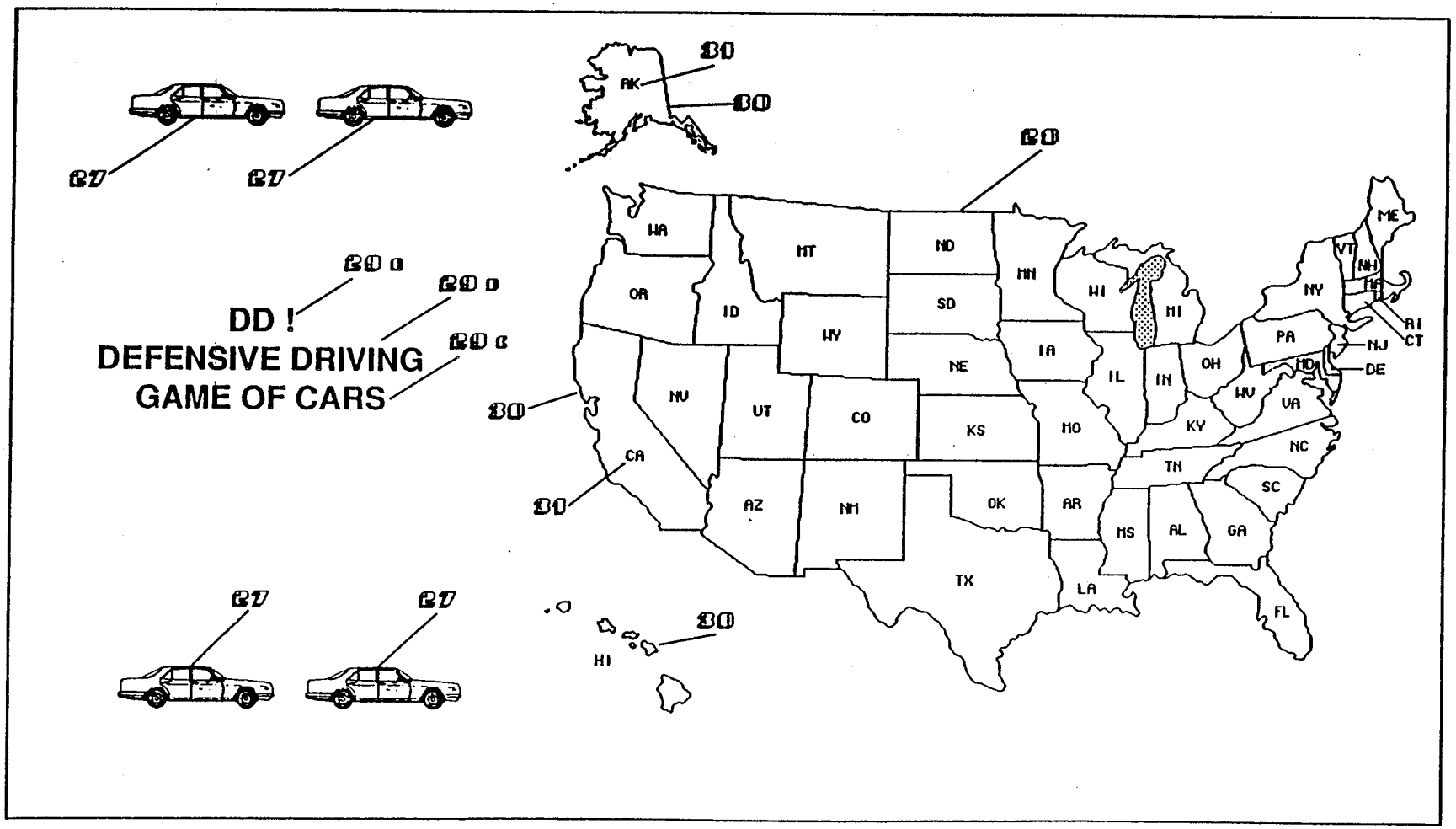
FIG. 5 is a plan view of the cover of the U.S. Cross Country Highway Game Board, placed on the reverse side of the board of FIGS. 1, 2, and 3, the map on said cover being a secondary game board.

FIG. 5, the plan view of the cover of the said U.S. Cross Country Highway Game Board of FIGS. 1, 2, said 3, cover being placed on the reverse side of the said board, has the following parts, said parts being identified by the following numerals, shadowed on the drawings and underlined on the descriptions:

27 is the CAR-PLAYING-PIECE of FIG. 6.

28 is a MAP OF THE UNITED STATES, showing the outline of each state, each state matching in color to the state area on the reverse side, 38 described below, of the spinner, FIG. 7, which has the states names, 31, described below, and state areas, 39 described below. The particular color does not matter as long as colors match for the individual state on FIG. 5 and for the same state on FIG. 7 and as long as no adjacent state in either FIG. 5 or FIG. 7 has the same color.

29*a*, 29*b*, and 29*c* are the consecutive parts of the TITLE, said title being "DD! DEFENSIVE DRIVING GAME OF CARS."

30 is a STATE OF THE UNITED STATES.

31 is the NAME OF A STATE OF THE UNITED STATES, which said name may be abbreviated.

FIG. 6

FIG. 6, showing two views of the eight individual car-playing-pieces used as the objects to be moved on the board, the color of each piece being identified by conventional color symbols, and said views being identified by the following shadowed numerals:

27 is the SIDE VIEW OF THE WOODEN CAR used as the object to be moved on the game board, which said car is in a plurality of eight cars with each said car being in an individual color, which said color matches the color of the home base, 2 and 3, described above, of FIGS. 1 and 3, said home base being that of the player using the particular said car, the said car color denoted by conventional color symbols. Said car may have painted-on windows, doors, bumpers, wheels, and tires. Each said set of eight cars comes in three sizes to fit the road sections of the different sizes of the main game boards, as follows: the car shown in the drawing, being 3 inches long, 1 inch wide, and 15/16 inch high, actual size as in the drawing, goes with the the 33 inches by 62¼ inches game board; a car that is 1 11/16 inches long, ½ inch wide, and ⅝ inches high goes with the 16½ inches by 31⅛ inches game board; a car that is 1 inch long, ⅜ inch wide, and ⅜ inch high goes with the 11 inches by 20¾ inches game board.

32 is a PLAN VIEW OF THE TOP OF THE WOODEN CAR of 27, described above, showing length, width, license number, and color, color denoted by conventional color symbols.

33 is the LICENSE NUMBER OF THE CAR, being painted on the back of each car to denote the player's said home base and order of play, as follows: NW-1 and NW-2 for Northwest Home Base; NE-1 and NE-2 for Northeast Home Base; SW-1 and SW-2 for Southwest Home Base; and SE-1 and SE-2 for Southeast Home Base, said home bases of FIGS. 1 and 3, these being 2 and 3, described above.

FIG. 7

FIG. 7, the plan view of the spinner, which is a flat-surfaced circle, ten inches in diameter, with one side used in both the beginners' and the advanced forms of the game to designate each player's home base, 2 and 3 of FIGS. 1 and 3 being described above, which said home base identifies said player's car-playing-piece; and to determine the order of play; and with the reverse side used in the young children's form of the game to designate the individual states of the United States, the area for each state being an individual color. The particular color does not matter as long as the color for a particular state on FIG. 7 is the same as the color for the same state on FIG. 5 and as long as no adjacent state area on either FIG. 5 or FIG. 7 has the same color. Said plan views have parts identified by the following numbers, shadowed on the drawings and underlined in the descriptions:

28 is a MAP OF THE UNITED STATES in the center of the front side, 35, described below, of the Spinner, the map being the same as 28 of FIG. 5, described above, except when used on the Spinner the said map need not have color on the individual states, being white outlined in black, nor need not have the states identified by name.

29A, 29B, and 29C are the consecutive PARTS OF THE TITLE of the game, said title being "DD!, DEFENSIVE DRIVING GAME OF CARS," the same title used on FIG. 5, 29A, 29B, and 29C, described above.

30 is a STATE OF THE UNITED STATES, being the same 30 as on FIG. 30 as on FIG. 5, described above.

31 is the NAME OF A STATE OF THE UNITED STATES, being same 31 as on FIG. 5, described above, which said name may be abbreviated.

34 is the COMBINED OBVERSE, 35, and REVERSE, 38, SIDES OF THE SPINNER.

35 is the OBVERSE SIDE OF THE SPINNER CIRCLE, said side being used in both the beginners' and the advanced forms of the game.

36 is the METAL KEY, three inches in length, representing a car key, for use as an arrow in spinning, being two keys, one for the obverse side and one for the reverse side of the spinner circle.

37 IS THE ABBREVIATION FOR A GEOGRAPHIC AREA, being related to the compass point, 1 of FIGS. 1 and 3, described above, in a plurality of four said geographic areas, designated by the letters NW for Northwest; NE for Northeast; SE for Southeast; and SW for Southwest, the said letters being placed on the peripheral of the spinner circle in geographic relationships to the said map, 28, described above. The said letters are those used as part of the licenses, 33, of the car-playing-pieces of FIG. 6, described above. Thus, the said metal key, 36, when pointing to one of these said geographic areas, designates the said car-playing-piece of FIG. 6, which car is assigned to the player spinning, and also designates the said home base, 2 of FIGS. 1 and 3, described above, which said home base is assigned to the player spinning.

38 is the REVERSE SIDE OF THE SPINNER CIRCLE, depicting and called a wheel of states, said side to be used in the young children's form of the game, to be played on the cover of the game board. On this said circle, the name of each of the fifty states of the United States is written, either the full or the abbreviated name, as in 31 of the map of FIG. 5, said states being in alphabetical order on the spinner.

39 is the INDIVIDUAL STATE AREA of the spinner to which the spinner key, 36 above, may point, on the said reverse side of the spinner circle, and thus designate the state on the map, 28, FIG. 5, to which the player may move his car-playing-piece in the young children's form of the game, played on the cover, FIG. 5, of the game board.

FIG. 8

Figure 8:
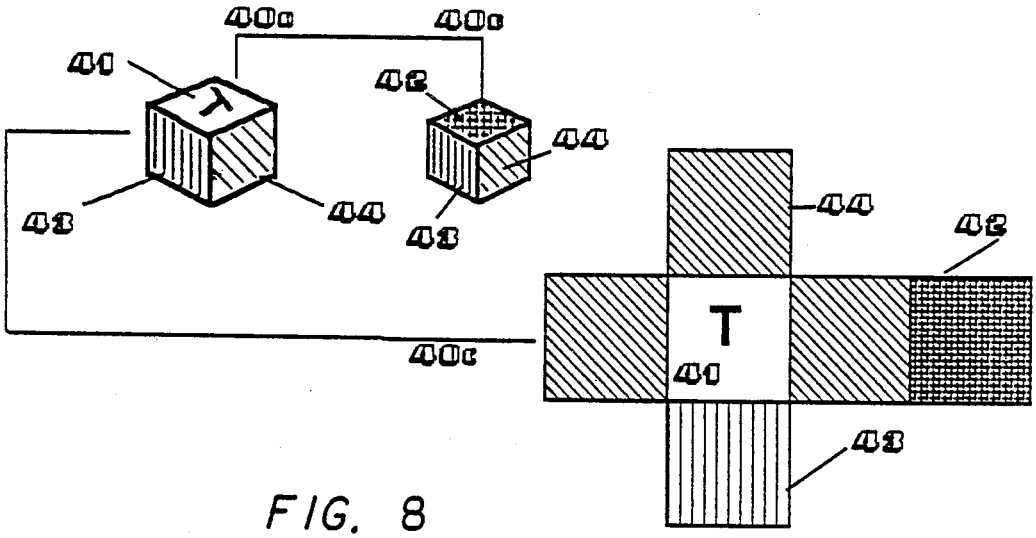
FIG. 8 shows the cube in a pictorial view with three sides, a pictorial view with the opposite three sides, and a plan view opened out to show all six sides, the color of said sides being traffic light colors of red, yellow, and green, and, also the regulatory-sign color of black and white, colors denoted by conventional color symbols, the said cube being used to determine who goes first in starting the game and in spinning to get one's home base and vehicle, in all forms of the game; and also used to determine the number of moves or the number of seconds to move allotted to the car-playing-piece, in the beginners' method of playing the game.

FIG. 8 shows the cube in a pictorial view with three sides, a pictorial view with the same cube turned upside down, and a plan view opened out to show all six sides, the traffic light colors of red, green, and yellow, and the traffic regulatory colors of black and white of the said sides being denoted by conventional color symbols. The said cube is to be used in the three forms of the game, the beginners', the advanced, and the young children's, to determine who goes first and is also used in the beginners' and young children's forms to determine the number of moves or the number of seconds to move allotted to each car-playing-piece. The size of the cube is one inch for the 33 by 62½ inches board; and three-fourths of an inch to be used with the smaller-sized boards. FIG. 8 has parts identified by the following numerals, shadowed on the drawings and underlined in the descriptions:

40A, 40B, and 40C portray ONE CUBE, with one side up at 40A; that said side down at 40B; and all sides opened out at 40C to show the individual color of each of the six sides and the arrangement of the said colors.

41 portrays the WHITE SIDE OF THE CUBE, which said side has a black letter T, the opposite and underneath side of the cube being yellow, described in 42, below.

42 portrays the YELLOW SIDE OF THE CUBE, opposite the white side, 41, above.

43 portrays a RED SIDE OF THE CUBE, the opposite side, unseen in the drawing 40A and 40B above, being green.

44 portrays a GREEN SIDE OF THE CUBE, one opposite side, unseen in the drawing 40A and 40B above, being green on one side and red on the other, and the other side opposite a green side being also green, so that there are three green, one red, one yellow, and one white side to the cube.

FIG. 9

Figure 9:
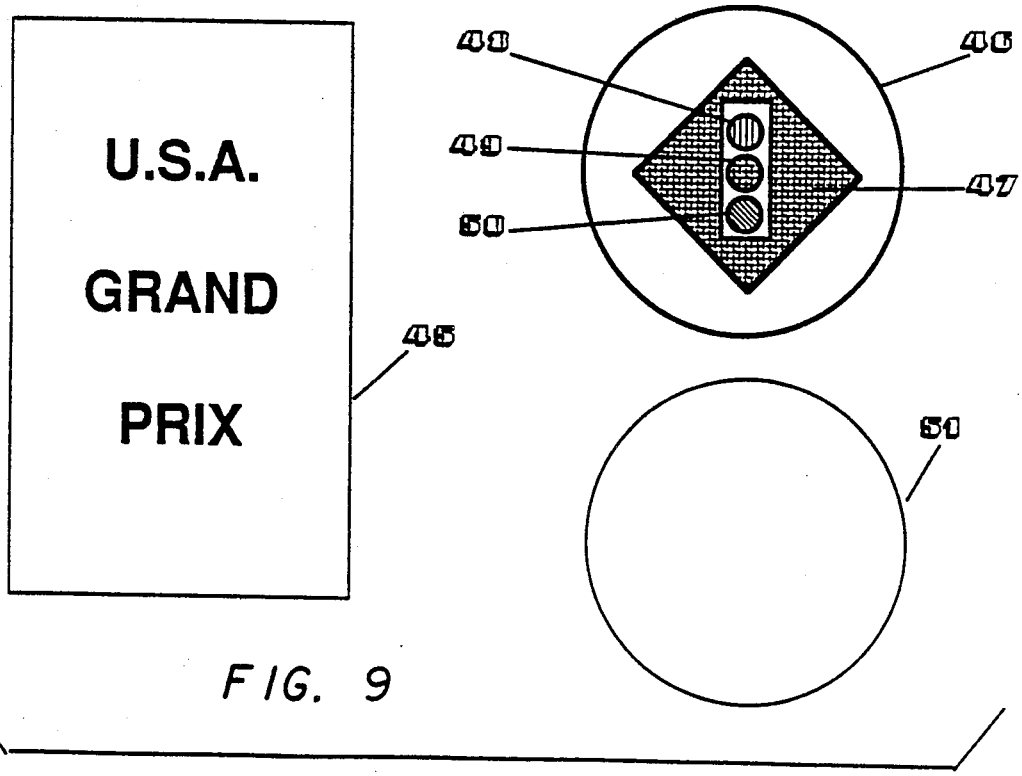
FIG. 9 shows the side, top, and bottom pictorial views of the container to hold the cube.

FIG. 9 shows three pictorial views of the container to hold the cube, being the side, the top, and the bottom views, with parts identified by the following numerals, shadowed on the drawings and underlined in the descriptions and with colors denoted by conventional color symbols on the drawings:

45 is the CYLINDER CONTAINER, being 3 and ½ inches high and 2 inches in diameter, with the words on one side being "U.S.A. Grand Prix."

46 is the LID FOR CONTAINER, 45 above.

47 is picture of YELLOW DIAMOND TRAFFIC WARNING SIGN.

48 is picture of a round RED TRAFFIC LIGHT.

49 is picture of a round YELLOW TRAFFIC LIGHT.

50 is picture of a round GREEN TRAFFIC LIGHT.

51 is BOTTOM OF CYLINDER CONTAINER, 45 above.

FIG. 10

Figure 10:
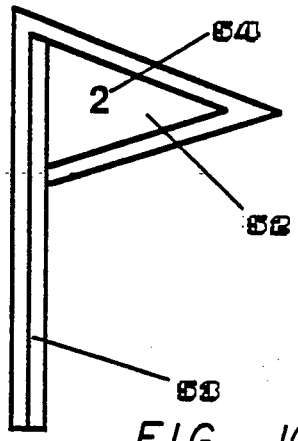
FIG. 10 shows a side pictorial view of the pennant.

FIG. 10, the side pictorial view of the pennant, to be used to designate the winners of the game and, also, the other players' order of returning to their home bases, has parts identified by the following numerals, shadowed on the drawings and underlined in the descriptions:

52 is the PENNANT TRIANGLE, being plastic or plastic-covered cardboard, blue on one side and white on the reverse side, 1 and ⅞ inches long on the two sides of the triangle and 1 inch long on its base.

53 is the WOODEN ROD to support the pennant of 52, said rod being concealed by plastic or by plastic-covered cardboard, extending from the pennant triangle, and said rod being 2 and ¾ inches long and ¼ inch in diameter.

54 is the NUMBER ON THE PENNANT, being the same number on both sides of each pennant triangle, with eight of the fifteen pennants having number 1 on both sides and the other seven having either number 2, 3, 4, 5, 6, 7, or 8 on both sides.

FIG. 11

Figure 11:
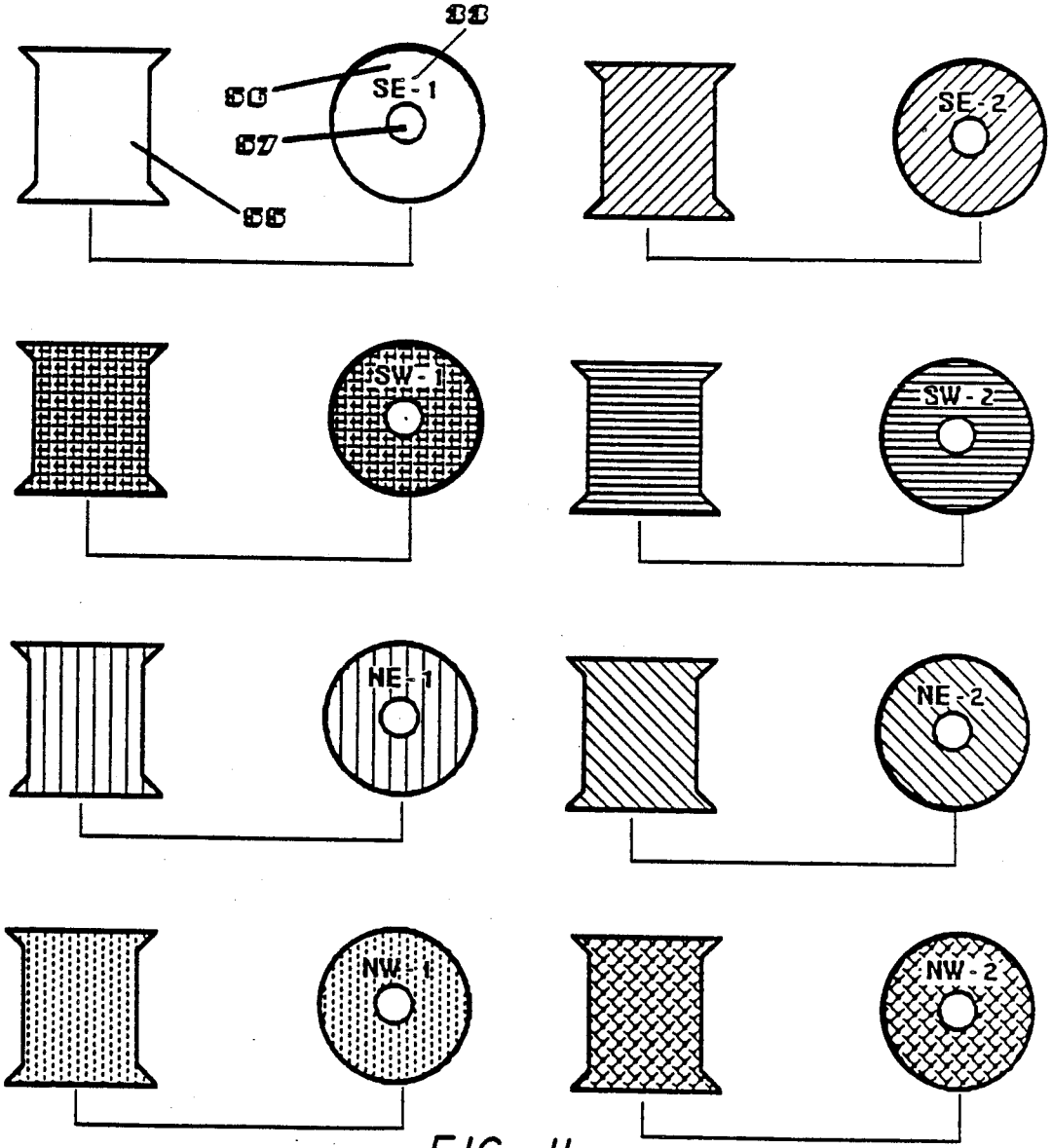
FIG. 11 shows two views of each of the eight stands used to hold the pennants: being a side pictorial view and a plan view of the top surface, each stand identified by its individual license number and color, to correlate with the licenses and colors of the car-playing-pieces of FIG. 6, said color being denoted by conventional color symbols.

FIG. 11, the two views of each of the eight stands used to hold the pennants, being a side pictorial view and a plan view of the top surface, each stand identified by its individual license number and color, to correlate with the licenses and colors of the car-playing-pieces of FIG. 6, said color denoted by conventional color symbols. FIG. 11 has parts identified by the following numerals, shadowed on the drawings and underlined in the descriptions.

33 is the LICENSE NUMBER, the same as 33 in FIG. 6.

55 is the WOODEN OR PLASTIC SPOOL.

56 is the TOP OF SPOOL, 55.

57 is the HOLE down through the center of said spool, 55, through which said hole the wooden rod, 53 of FIG. 10, is placed.

FIG. 12

Figure 12:
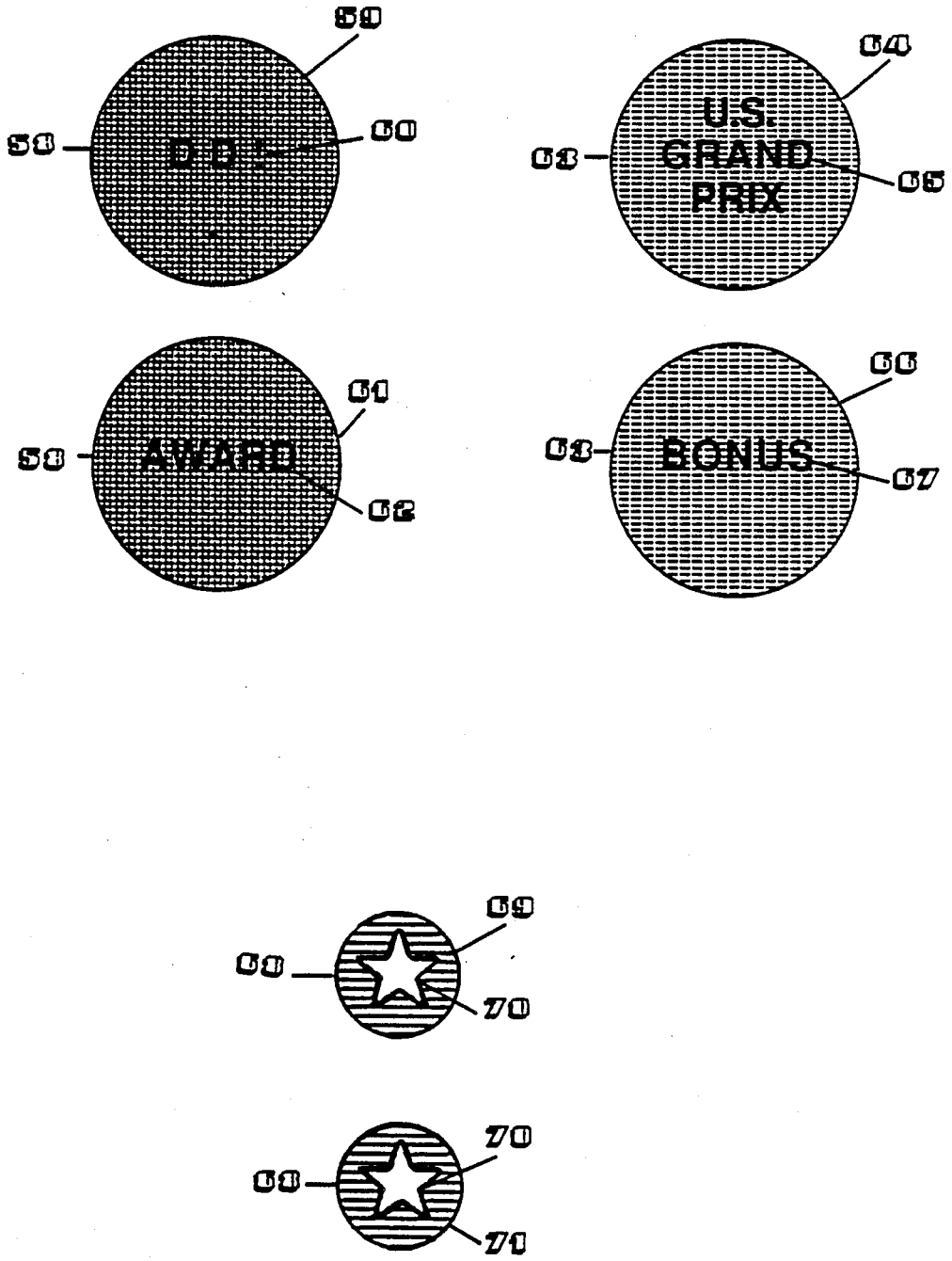
FIG. 12 shows a plan view of the three disks, being the gold award disk used in the advanced form of the game; the silver bonus disk used in the beginners' form of the game; and the blue disk with the white star design, used in the children's form of the game, said colors denoted by conventional color symbols.

FIG. 12 is a plan view of each of three flat disks, being the award disk of 1 and ½ inches in diameter, to be used in the advanced form of the game; the bonus disk of 1 and ½ inches in diameter to be used in the beginners' form of the game; and the starred disk of ¾ inch in diameter, to be used in the children's form of the game, which said disk may be cardboard, plastic, or metal, each disk having parts identified by the following numerals, shadowed on the drawings and underlined in the descriptions and with colors denoted by conventional color symbols on the drawings:

58 is a plan view of the GOLD AWARD DISK, showing the two sides, being the obverse and reverse sides.

59 is the OBVERSE SIDE OF THE GOLD AWARD DISK.

60 is the LETTERS ON THE GOLD DISK, OBVERSE SIDE, being DD!.

61 is the REVERSE SIDE OF THE GOLD AWARD DISK.

62 is the WORD ON THE GOLD DISK, REVERSE SIDE, being Award.

63 is a plan view of the SILVER BONUS DISK, showing the two sides, being the obverse and reverse sides.

64 is the OBVERSE SIDE OF THE SILVER BONUS DISK.

65 is the WORDS ON THE SILVER DISK, OBVERSE SIDE, being U.S. Grand Prix.

66 is the REVERSE SIDE OF THE SILVER BONUS DISK.

67 is the WORD ON THE SILVER DISK, REVERSE SIDE, being Bonus.

68 is a plan view of the BLUE STARRED DISK, showing the two sides, being the obverse and reverse sides.

69 is the OBVERSE SIDE OF THE BLUE STARRED DISK.

70 is the STAR painted white on both sides of the blue starred disk.

71 is the REVERSE SIDE of the blue starred disk.

FIG. 13

Figure 13:
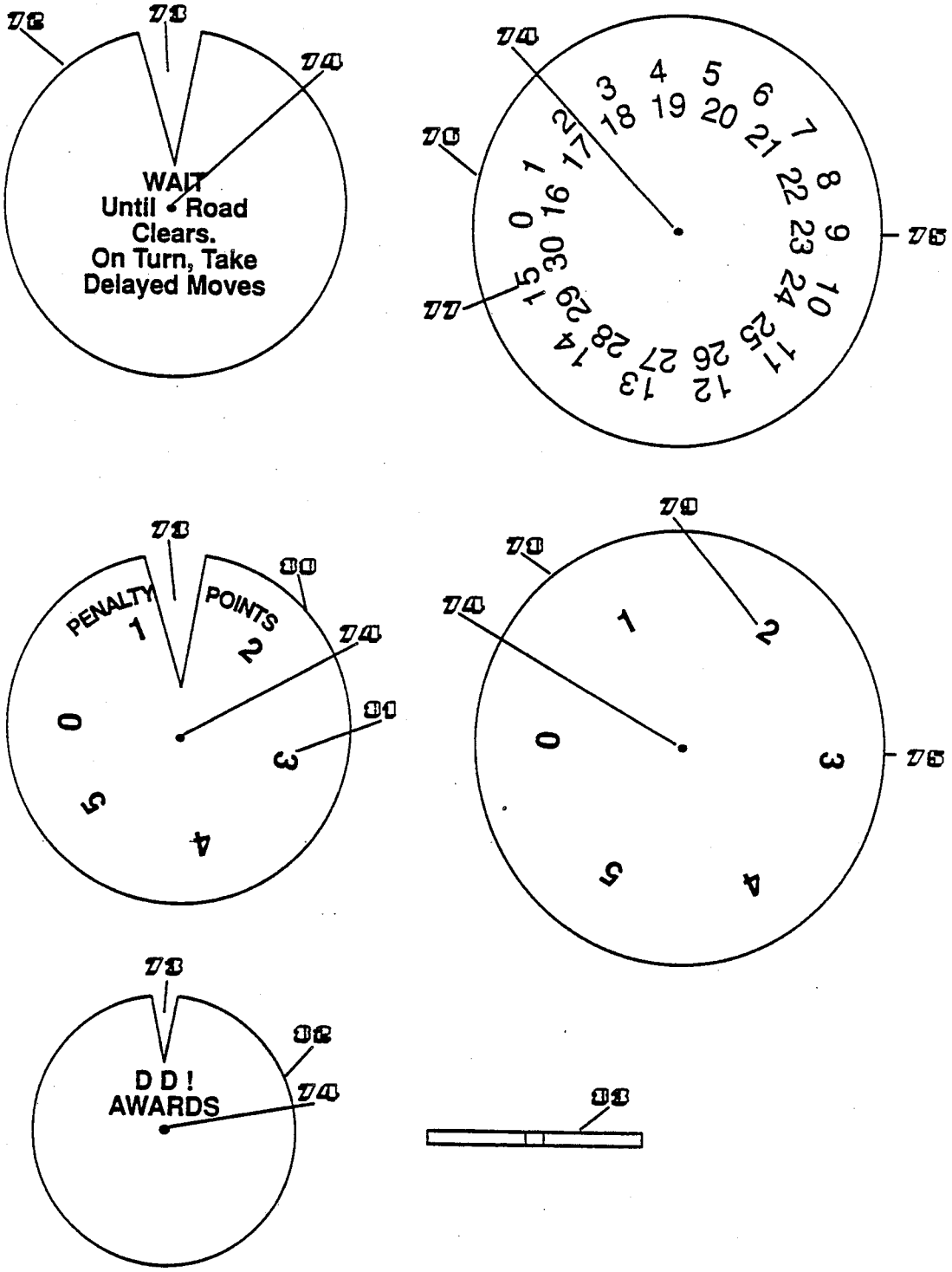
FIG. 13 shows a plan view of the combined Wait, Penalty, and Award circular cards, making up the Records Wheel.

FIG. 13 shows the combined Wait, Penalty, and Awards circular cards, called the Records Wheel, being eight in number, one for each player, to be used in both the beginners' and the advanced forms of the game to record waits, penalties, and awards, each said Record Wheel having parts identified by the following numerals, shadowed on the drawings and underlined in the descriptions:

72 is the WAIT CARD, being circular, 2 and ⅝ inches in diameter, being orange in color, which is the traffic color of road construction, and being used with the lettered side facing out. Said Wait Card is placed on top of the Number of Waits Card, 76, described below.

73 is the NOTCH, through which are viewed the number of waits, penalties, or awards, one notch being in the Wait Card, 72, through which said notch can be seen the numbers on the Wait Numbers Card 76 below;; one notch being in the Penalty Card, 80, below, through which said notch can be seen the numbers on the Penalty Numbers Card, 78 below; and one notch being in the Awards Card, 82 below, through which said notch can be seen the awards numbers on the Penalty Card, 80 below. By turning the wheel of the said Numbers Card between the said Wait Card and the said Penalty Card, the player matches the number of either the waits or the penalties he has been given with the number of the waits or of the penalties which can be seen through the notch either on the said Wait Card or on the said Penalty Card, and thus he keeps a record of his waits and penalties. By turning the wheel of the said Awards Card, the player matches the number of awards he has been given with the number of the awards on the said Penalty Card, which said number of awards can be seen through the notch of the Awards Card, and thus he keeps a record of his awards.

74 is the HOLE in the center of the four circular cards, being the said Wait Card, 72, the said Numbers Card, 75, the said Penalty Card, 80, and the said Awards Card, 82, through which the said four cards are fastened together by a metal fastener, 83 below.

75 is the NUMBERS OF WAITS AND OF PENALTIES CARD, OBVERSE AND REVERSE SIDES, being circular, 3 and ⅛ inches in diameter, and being the middle card, between the Wait Card, 72 above, and the Penalty Card, 80 below. Each one of the eight said Numbers of Waits and of Penalties Card match in color one of the eight car-playing-pieces of FIG. 6, to identify the player to whom the said records of waits, penalties, and awards belong. On the portrayed obverse side 76 of this said Numbers Card, the numbers of possible waits are each printed. On the portrayed reverse side, 78, of this said Numbers Card, the numbers of possible penalties are each printed.

76 is the NUMBERS OF WAITS CARD, OBVERSE SIDE OF NUMBERS CARD, 75, on which said side of the said circular middle card are printed the numbers from 0 through 30. This said numbered side faces so that the numbers can be seen within the notch 73 of the Wait Card, 72, since the said Wait Card is placed on top of the said wait side of the Numbers Card, and thus the said visible number records the number of waits the player has been awarded.

77 is a WAIT NUMBER, one of thirty.

78 is the NUMBERS OF PENALTIES CARD, REVERSE SIDE OF NUMBERS CARD, 75, on which said side of the said circular middle card are printed the numbers from 0 through 5. This said numbered side faces so that the numbers can be seen within the notch, 73, of the Penalty Card, 80, since the said Penalty Card is placed on top of the said penalty side of the Numbers Card, and thus the said visible number records the number of penalties the player has incurred.

79 is a PENALTY NUMBER, one of five.

80 is the PENALTY CARD, being circular, 2⅝ inches in diameter; being yellow in color, which is the traffic color of caution or warning; and being used with the lettered side facing out. Said Penalty Card is placed on top of the Number of Penalties Card, 78.

81 is an AWARD NUMBER, one of five.

82 is the AWARDS CARD, being circular, 2 inches in diameter; being white in color; and being used with the lettered side facing out. Said Awards Card is placed on top of the Penalty Card, 80, so that one of the five awards numbers, 81, may be seen through the Notch, 73, when the said Awards Card is turned. Thus the said visible number records the number of awards the player has earned.

83 is the METAL FASTENER with two prongs which go through the Hole, 74, on the four circular cards of Wait, 72, Numbers, 75, Penalty, 80, and Awards, 82, and then the prongs spread open to hold the said four cards together.

FIG. 14

FIG. 14 shows the three cards to be held by each player while driving on the board with the said car-playing-piece of FIG. 6: the Route Card, the Driver's License Card, and the Insurance Policy Card, each being eight in number, one of each for each player, each said cards with parts identified by the following numerals, shadowed on the drawings and underlined in the descriptions. Sizes of the drawings are the actual sizes of the said cards.

84 is the ROUTE CARD, being white in color and 3 and 15/16 inches by 5 and ⅝ inches in size, and being a different route for each player, said route card giving the individual player's route on the said main game board, called the U.S. Cross Country Highway Board. Since each player must complete all the routes after starting from his individual home base and since every two players go a different direction from the other six players in making a round trip of the four U.S. Routes and of the Interstate Highway, each said player has his own particular Route Card by which his said playing piece is guided.

85 is the MAP OF A ROUTE, showing the route on the said main game board from each player's individual home base, 2 of FIG. 1 and 3, back to the same said home base. The map in the portrayed example gives the route to be taken by the players with the car-playing-pieces licensed SE-1 and SE-2.

5 is the U.S. ROUTE SIGN, as described under FIG. 1 and 3.

86 is the DRIVER'S LICENSE CARD, one for each player, card perhaps blue and being 3 inches by 1 and 15/16 inches in size.

33 is the LICENSE NUMBER OF THE CAR-PLAYING-PIECE of FIG. 6, said license number identifying the player to whom the particular card belongs. On the Driver's License Card, the DD stands for Defensive Driver. On the portrayed example, the license is SE-2.

87 is the INSURANCE POLICY CARD, one for each player, card perhaps pink and being 2 and ⅜ inches by 5 inches in size.

FIG. 15

Figure 15:
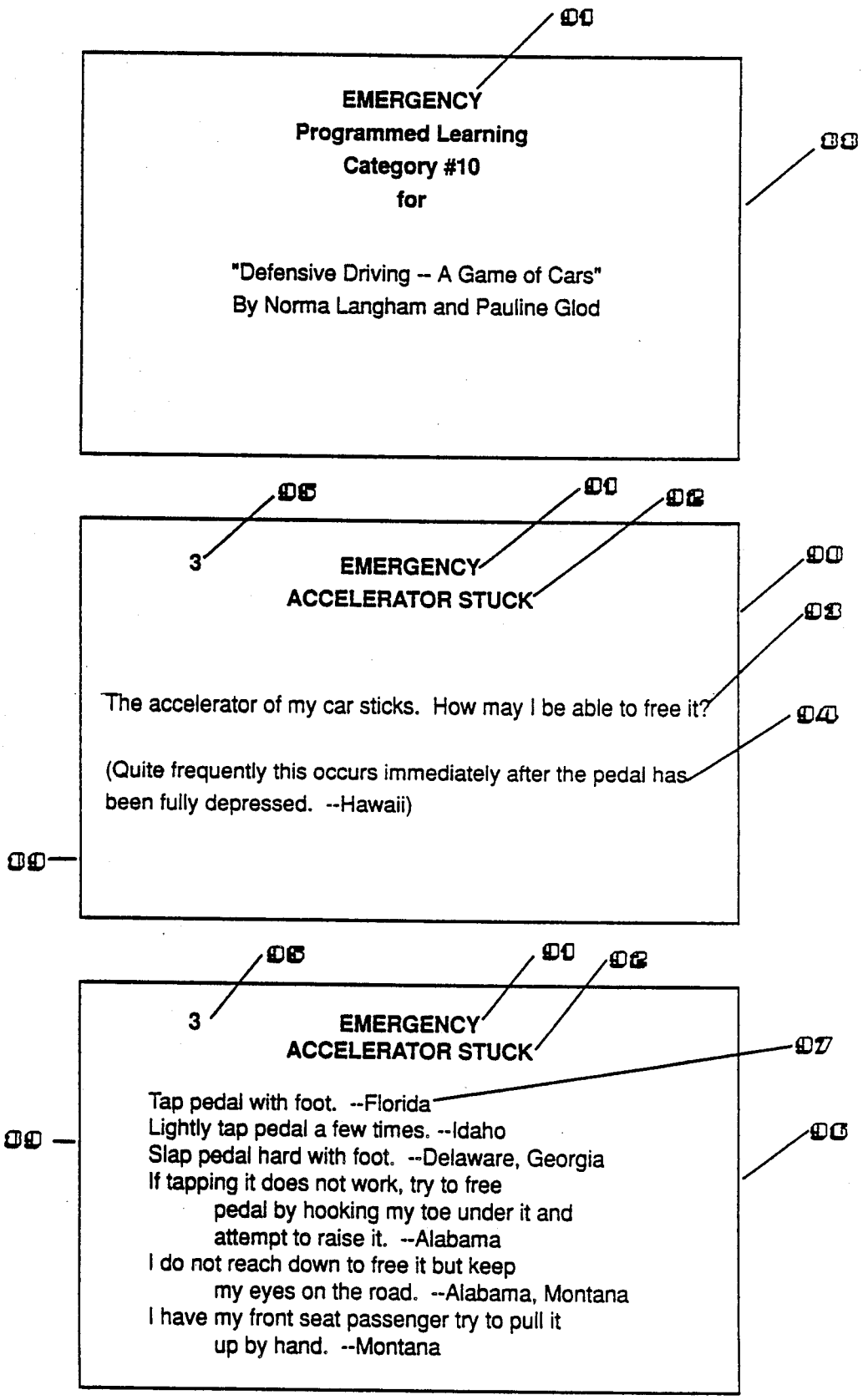
FIG. 15 portrays the cards of the traffic-situations' questions and answers, being a title of a category, a sample question, and a sample answer. Portrayed in the drawings as cards, the said traffic situations' questions and answers may also be in programmed learning books; computer discs; television programs; slide or video or audio cassettes.

FIG. 15 portrays the traffic-situations' questions and answers with the title of a category. Herein portrayed on cards, these questions and answers and title are also in programmed-learning books and may be put on computer discs, television programs, slides, or video or audio cassettes. Each of these said questions and answers and title have parts identified by the following numerals, shadowed on the drawings and underlined in the descriptions:

88 is the TITLE CARD for one category, "Emergency," of the traffic-situations questions and answers, herein portrayed as on a card. Each category deals with a particular driving skill or knowledge. The titles of the thirty-six categories are as follows: 1. Accident; 2. Animals; 3. Backing; 4. Bicyclists; 5. Brakes; 6. Car Breakdown; 7. Car Care; 8. Carbon Monoxide; 9. City Driving; 10. Collision; 11. Communicating; 12. Country Roads; 13. Defensive Driving; 14. Driver; 15. Driving Maneuvers; 16. Emergency; 17. Fog; 18. Hydroplanting; 19. Interstate Driving; 20. Lights; 21. Motorcycles; 22. Parking; 23. Passing; 24. Pedestrians; 25. Right of Way and Intersections; 26. Safety; 27. Seeing; 28. Skidding; 29. Slippery Road; 30. Snow and Ice; 31. Space Cushion; 32. Speed; 33. Tires; 34. Traffic Signs, Signals, and Pavement Markings; 35. Trip Planning and Routes; 36. Turns. A set may consist of one category or may be a mixture of situations from all categories.

89 is the COMBINATION OF QUESTION AND ANSWER CARD, WITH THE QUESTION ON THE OBVERSE SIDE AND THE ANSWER ON THE REVERSE SIDE, as described in 93 and 97 below. These said questions and answers are 2000 in number.

90 is the QUESTION SIDE OF THE CARD, the obverse side of the combination of question and answer card, 89 above, said question material including the category, section of the category, question number, and question sentence, and, at times, including further information, a picture, and a state source. Each question is a problem expressed as "What do I do in this traffic situation?" First person is used as "What do I do?" rather than second person, which would be "What do you do?", and this form makes the problem a personal responsibility and experience, as if the player is facing an actual situation on a highway.

91 is the TITLE OF THE CATEGORY, said category being a set of questions and answers, said title being in this example "Emergency."

92 is the SECTION, OR SUBTITLE, OF THE CATEGORY, in this example being "Accelerator Stuck," being the group of questions dealing with the emergency of a stuck accelerator. There may be any number of cards in a section, being as many as are needed to cover that section.

93 is the particular QUESTION, some questions being illustrated with a black-and-white or colored picture as depicted in a driver's manual.

94 is INFORMATION ABOUT THE QUESTION-SITUATION, said information being given with some of the questions.

95 is the NUMBER OF THE QUESTION AND ANSWER in one category, the said questions and answers being arranged by number in a logical order to help in the learning process. The numerical size of a category-set varies from eleven questions and answers in the "Animal" category to 184 questions and answers in the "Parking" category, with an average of 55 numbers to each category-set.

96 is the ANSWER SIDE OF THE CARD, said answer material including the category, section of the category, answer number, and answer sentence or sentences. The answer sometimes includes a black-and-white or colored picture as depicted in a driver's manual and usually includes a state source. Said answer is the reverse side of the combination of question and answer card, 89 above.

97 is the ANSWER OR ANSWERS, being a solution or solutions to a particular traffic-situation problem, with one or more states being listed as the source. Answers from several states may be given, as in the portrayed example, to show variations between state laws or advice. When answers are common to the fifty states, no state source is given.

LIST OF THE NAMES OF THE PREFERRED EMBODIMENTS

The following preferred embodiments, previously described in detail, pages 6 to 23, are listed here as a convenient reference to the drawings, in examining the method of playing the game. On the drawings, the reference numbers are shadowed numerals. On this list, as in the above detailed descriptions, the reference numbers are underlined numerals.

FIGS. 1, 2, 3, and 4:

FIGS. 1, 2, and 3 are the three longitudinal sections of the main game board, called the U.S. Cross Country Highway Game Board.

FIG. 4 is the bridge which goes over the Interstate Highway on the main game board and a section of the said Interstate Highway, with the example of how a bridge is placed to be attached.

1: COMPASS POINT
2: HOME BASE STARTING POINT
3: HOME BASE FINISHING POINT
4: DIRECTIONAL ARROW
5: U.S. ROUTE SIGN
6: U.S. ROUTE COLORED ROAD SECTION
7: U.S. ROUTE GREY ROAD SECTION
8: INTERSTATE HIGHWAY COLORED ROAD SECTION
9: INTERSTATE HIGHWAY GREY ROAD SECTION
10: GEOGRAPHIC PLACE, CITY, RESORT, OR PARK
11: GREY ROAD AREA BETWEEN THE INTERSTATE HIGHWAY AND THE U.S. ROUTES
12: YELLOW LINE, BROKEN OR SOLID, ON THE ROAD
13: WHITE LINE, BROKEN OR SOLID, ON THE ROAD

14: INTERSTATE HIGHWAY ENTRANCE AND EXIT
15: GREY ROAD AREA FOR ENTERING AND LEAVING THE GEOGRAPHIC PLACES
16: GRASSY AREA
17: BARRIER OF BLACK DIAGONAL STRIPES ON THE WHITE AREA
18: STOP SIGN
19: YIELD SIGN
20: FOLDED DIAMOND INTERCHANGE RAMP
21: CLOVERLEAF INTERCHANGE RAMP
22: TRUMPET INTERCHANGE RAMP
23: SLOTTED AREA IN WHICH TO FASTEN THE BRIDGE
24: BRIDGE ENTRANCE AND EXIT ROAD
25: BRIDGE
26: BRIDGE AREA COVERED UNDER SLOT
FIG. 5: THE COVER OF THE GAME BOARD
27: CAR-PLAYING-PIECE of FIG. 6
28: MAP OF THE UNITED STATES
29A, 29B, 29C: TITLE, in consecutive parts
30: STATE OF THE UNITED STATES
31: NAME OF A STATE OF THE UNITED STATES
FIG. 6: THE CAR-PLAYING-PIECE
27: CAR-PLAYING-PIECE, side view, as in FIG. 5
32: TOP OF CAR-PLAYING-PIECE of 27
33: LICENSE NUMBER OF THE CAR-PLAYING-PIECE of 27
FIG. 7: THE SPINNER
28: MAP OF THE UNITED STATES, as in FIG. 5, 28
29A, 29B, 29C: TITLE in consecutive parts as in FIG. 5, 29A, B, C
30: STATE OF THE UNITED STATES, as in FIG. 5, 30
31: NAME OF A STATE OF THE UNITED STATES, as in FIG. 5, 31
34: COMBINED OBVERSE AND REVERSE SIDES OF THE SPINNER
35: OBVERSE SIDE OF THE SPINNER CIRCLE
36: METAL KEY
37: ABBREVIATION FOR A GEOGRAPHIC AREA
38: REVERSE SIDE OF THE SPINNER CIRCLE
39: INDIVIDUAL STATE AREA of the spinner
FIG. 8: THE CUBE
40A, 40B, 40C: ONE CUBE, one side up at 40A; said side down at 40B; all sides opened out at 40C
41: WHITE SIDE OF THE CUBE
42: YELLOW SIDE OF THE CUBE
43: RED SIDE OF THE CUBE
44: GREEN SIDE OF THE CUBE
FIG. 9: CONTAINER TO HOLD THE CUBE
45: CYLINDER CONTAINER
46: LID FOR CONTAINER
47: YELLOW DIAMOND TRAFFIC WARNING SIGN, picture
48: RED TRAFFIC LIGHT, picture
49: YELLOW TRAFFIC LIGHT, picture
50: GREEN TRAFFIC LIGHT, picture
51: BOTTOM OF CYLINDER CONTAINER
FIG. 10: THE PENNANT
52: THE PENNANT TRIANGLE
53: WOODEN ROD
54: NUMBER ON THE PENNANT
FIG. 11: THE STANDS TO HOLD THE PENNANTS
33: LICENSE NUMBER, the same as 33 in FIG. 6
55: WOODEN OR PLASTIC SPOOL
56: TOP OF SPOOL
57: HOLE, to hold pennant of FIG. 10
FIG. 12: THE DISKS
58: GOLD AWARD DISK, two sides, being obverse and reverse sides
59: OBVERSE SIDE, GOLD AWARD DISK
60: LETTERS ON GOLD DISK, OBVERSE SIDE, being DD!
61: REVERSE SIDE, GOLD AWARD DISK
62: WORD ON THE GOLD DISK, REVERSE SIDE, being Award
63: SILVER BONUS DISK, two sides, being obverse and reverse sides
64: OBVERSE SIDE, SILVER BONUS DISK
65: WORDS ON THE SILVER DISK, OBVERSE SIDE, being U.S. Grand Prix
66: REVERSE SIDE, SILVER BONUS DISK
67: WORD ON THE SILVER DISK, REVERSE SIDE, being Bonus
68: BLUE STARRED DISK, two sides, being obverse and reverse sides
69: OBVERSE SIDE, BLUE STARRED DISK
70: STAR, painted white on both sides of blue starred disk, 68
71: REVERSE SIDE, BLUE STARRED DISK
FIG. 13: WAIT, PENALTY, AND AWARD CIRCULAR CARDS, MAKING UP THE RECORDS WHEEL
72: WAIT CARD
73: NOTCH through which are viewed the number of waits, penalties, or awards
74: HOLE through which the Wait Card, 72, Numbers Card, 75, Penalty Card, 80, and Awards Card, 82, are fastened together
75: NUMBERS OF WAITS AND OF PENALTIES CARD, OBVERSE AND REVERSE SIDES
76: NUMBERS OF WAITS CARD, OBVERSE SIDE OF NUMBERS CARD, 75
77: WAIT NUMBER, one of thirty
78: NUMBER OF PENALTIES CARD, REVERSE SIDE OF NUMBERS CARD, 75
79: PENALTY NUMBER, one of five
80: PENALTY CARD
81: AWARD NUMBER, one of 5
82: AWARDS CARD
83: METAL FASTENER to hold four cards of FIG. 13 together
FIG. 14: CARDS OF DRIVER'S LICENSE, INSURANCE POLICY, AND ROUTE
84: ROUTE CARD
85: MAP OF A ROUTE
5: U.S. ROUTE SIGN, as described under FIGS. 1 and 3
86: DRIVER'S LICENSE CARD
33 LICENSE NUMBER OF CAR-PLAYING-PIECE, same as 33, FIG. 6
87: INSURANCE POLICY CARD
FIG. 15: CARDS OF TRAFFIC-SITUATIONS' QUESTIONS AND ANSWERS
88: TITLE CARD for one category
89: COMBINATION OF QUESTION AND ANSWER CARD, WITH THE QUESTION ON THE OBVERSE SIDE AND THE ANSWER ON THE REVERSE SIDE
90: QUESTION SIDE OF QUESTION AND ANSWER CARD, 89
91: TITLE OF THE CATEGORY 92: SECTION OF THE CATEGORY, BEING THE SUBTITLE
93: THE QUESTION
94: INFORMATION ABOUT THE QUESTION
95: NUMBER OF THE QUESTION AND ANSWER
96: ANSWER SIDE OF QUESTION AND ANSWER CARD, 89
97: THE ANSWER.

THE TWO METHODS OF PLAYING THE GAME ON THE MAIN GAME BOARD, FIGS. 1, 2, AND 3:

This board game in its beginners' form and in its advanced form is played on the main board of FIGS. 1, 2, and 3, called the U.S. Cross Country Highway Game Board. In said game, the players move car-playing-pieces of FIG. 6, on pathways of divided traffic lanes of U.S. Routes, 6 and 7, and an Interstate Highway, 8 and 9, which said Interstate has the Interchanges, 20, 21, and 22, and the bridges, 25, all these said pathways being used in common by all car-playing-pieces. The players move said car-playing-pieces from a Starting Point of a Home Base, 2, to a Finishing Point of the same Home Base, 3, said Home Bases being on the four different corners of the board, each base being adjacent to a compass point, 1, which said starting and finishing points allow the movement of traffic in opposite directions. The movement of each said car-playing-piece is brought about by each player, in turn, either by throwing a colored cube of FIG. 8, or by correctly answering questions of traffic situations, FIG. 15, the cube being used in the beginners' method of playing the game, and the traffic-situations' questions and answers being used in the advanced players' method of playing the game. The players, as drivers, must obey traffic regulations to avoid traffic violations and penalties.

A game consists of a complete round trip on the U.S. Routes and on the Interstate Highway. In the advanced game, each player must use at least one interchange, by following the arrows, to cross the Interstate Highway to go to a city or resort, 10, on the opposite side of the board, doing this on one of his or her regular moves. The player may eliminate some miles of colored road sections by using any of the ramps, 20, 21, and 22, off and then back onto the Interstate Highway by using the next nearest ramp. Using the said interchanges and ramps is optional for the beginners' game.

NUMBER OF PLAYERS: From one to sixteen players may play, depending on the size of the said main game board used, which board is made in three sizes to accomodate different numbers of players, said sizes described on page 4. A set of eight car-playing-pieces, FIG. 6, being in the appropriate size to fit the particular said game board used, size described on page 15, are to be furnished with each said main game board, one or more said cars to each player, depending on the number of players and their decisions as to using one or more cars. When over eight players play on the largest said game board, any additional player will either bring his own toy car or be a co-driver. Such a co-driver makes a team of two to take turns moving the said car-playing-piece and to consult on and answer traffic questions. Any number of players may choose to have co-drivers or to play in teams. Any player may use his or her own toy car or model car.

DETERMINING THE ORDER OF PLAY BY USING THE CUBE, FIG. 8: Each player throws the said colored cube, with the traffic-light colors of red, green, and yellow. The first player who throws the green side up on top of the cube gets to go and thus is first in starting the game. Each person's turn comes when he is the next person to the left of anyone who has just finished a turn.

DETERMINING EACH PLAYER'S HOME BASE AND CAR-PLAYING-PIECE BY USING THE SPINNER, FIG. 7, ON ITS OBVERSE SIDE, 35. The said starting player spins the car key, 36, on the obverse side, 35, of the said spinner, which, when said key stops, points to the letters either NW, NE, SW, or SE, being abbreviations for a geographic area, 37. The said letters match on the said game board what will be that said player's said home base, 2. If there is doubt about the exact area to which the key points, the said player spins again. Then, said player gets the said car-playing-piece which has the license number 1, 33, of that said home base. He also gets a stand, FIG. 11, to be used later to hold a pennant, FIG. 10, the said stand matching the color and license number, 33, of his said car-playing piece; a driver's license card, 86 of FIG. 14; an insurance policy card, 87 of FIG. 14; a map-route card, 84 of FIG. 14, each said driver's license, insurance card, and route card having the corresponding said license number; and a Records Wheel, FIG. 13, made up of the Wait Card, 72, the Numbers Card, 75, the Penalty Card, 80, and the Awards Card, 82. The Numbers Card, 75, the Penalty Card, 80, and the Awards Card, 82. The next player to the starting player's left spins, followed in succession by all players to the left. If the said car key points to an area already allotted as said Home Base #1, the player takes Home Base #2 of the said home base area. If both said Home Bases #1 and #2 are already allotted, the player spinning spins again until he gets his own individual area not taken by another player.

PLAYERS GETTING INTO PLACE: When each player has his said car-playing-piece, stand, license, insurance card, route card, and Records Wheel of Wait, Numbers, Penalty, and Awards, all players take their places at their said allotted individual Home Bases, each one found at a corner of the said game board as indicated by the said compass points there, being the said Northeast, the Northwest, the Southeast, or the Southwest corner. Those with license #2 stand or sit to the left of license #1 in the same geographic area. The players put their car-playing-pieces on their assigned Home Bases, at the word START. Up to four additional players more than the eight usual players take license #3 of each said compass point area, each said additional player sitting to the left of a player with license #2 and placing his own toy car behind the car with said license #1. Up to four additional players more than twelve players take license #4 of each said area, each said additional player sitting to the left of the player with license #3 of the said area and placing his toy car behind the car with said license #2. A co-driver sits to the left of his team-mate. Thus, one or two of the eight vehicles, plus any added vehicles, occupy the home bases, with licenses as follow:

Cars NW-1 and NW-2 on Northwest Home Base;
Cars SW-1 and SW-2 on Southwest Home Base;
Cars NE-1 and NE-2 on Northeast Home Base;
Cars SE-1 and SE-2 on Southeast Home Base.

If using another vehicle than those furnished with the game, the player uses the license number he gets from spinning the wheel.

BEGINNING TO PLAY: The starting player beings the game and is followed, in turn, by each player to his or her left.

THE ROUTE FOR MOVING THE CAR-PLAYING-PIECE ON THE BOARD: Each player moves his said car-playing-piece by following his said route card, FIG. 14, 84, in the direction of the arrows, 4, on the said game board. He starts from his said Home Base, 2, where the word START is printed, and makes a round trip on the said pathways of the U.S. Routes, indicated by Route 10 on the southern border, Route 101 on the west coast, Route 30 on the northern border, and Route 1 on the east coast, all said routes identified by route signs, 5, and by the U.S. Route Colored Road Sections, 6, and the U.S. Route Grey Road Sections, 7, on the board. Each must also make a round trip on the Interstate Highway, entering it at the place marked on the route card, being 14, going the length of the Interstate across the center of the board, exiting the Interstate, making a U-turn, reentering the Interstate, and traveling the full length again to the far exit, the Interstate pathway being identified by the Interstate Highway Colored Road Sections, 8, and the Interstate Highway Grey Road Sections, 9.

In the advanced game, each player must travel at least one interchange, either the Folded Diamond Interchange, 20, the Cloverleaf Interchange, 21, or the Trumpet Interchange, 22, following the arrows, 4, to cross the Interstate Highway to go to a city or resort, 10, on the opposite side of the board, on one of his or her regular moves. The player may eliminate some miles of colored road sections by using any of the ramps, 20, 21, or 22 to get off the Interstate and then by using immediately the next nearest ramp to get back on the Interstate. Using the Interchanges and ramps is optional for the beginners' game.

After completing the round trips on the U.S. Routes and the Interstate Highway, including any interchanges, the player returns to his Home Base, 3, to the printed word FINISH. If a player gets off his or her route for any reason, one must get back on it by using his or her allotted moves.

THE DISTANCE FOR EACH INDIVIDUAL MOVE OF THE CAR-PLAYIN-PIECE: The players, as a group, choose to move the car-playing-pieces either by moving across five colored road sections, or by moving across as many colored road sections as possible while five seconds are counted off by a chosen player, as one-thousand-one through one-thousand-five, the latter being the way highway experts measure highway distances. The said colored road sections are those of the U.S. Routes, 6, and of the Interstate Highway, 8. The player stops his car-playing-piece on the final allotted colored section and waits there for his or her next turn.

USING EITHER METHOD 1, THE CUBE, OR METHOD 2, THE TRAFFIC-SITUATIONS' QUESTIONS AND ANSWERS, TO MOVE THE CAR-PLAYING-PIECE:

Method 1, Using the Cube of FIG. 8:

Using the cube, because of its traffic-regulation colors, determines when and how far the player can move his or her car-playing-piece in the beginners' form of the game, said form called the U.S. Grand Prix, a U.S. Cross Country Race, being a game of chance involving some skill. In this fast game, beginners learn the use of the main game board of FIG. 1, 2, and 3, perhaps with its interchanges, 20, 21, and 22, and bridges, 25, and learn, also, the beginners' driving skills of following a route and a map, passing, stopping at stop signs, keeping one's car on the road and in one's lane, sharing the road, and other safe driving practices. Before beginning the game, the players as a group decide whether the moves will be counted by the number of colored road sections crossed or by the number of seconds of one-thousand-and-one for each second allotted to cross any number of colored road sections. The said cube by color and by one letter indicates when and how far the player may move, according to the said choice of the group as to moving by the number of colored road sections or by the number of seconds allotted to move, from his or her Home Base, 2, and subsequently from a colored road section either of a U.S. Route pathway, 6, or of an Interstate Highway pathway, 8, to the next said colored road section on the same said pathway. The procedure according to the color side up of the said cube follows:

Green: By throwing a green side up on top of the cube, 44, the player has a go traffic signal with the count of five colored road sections to move across or five seconds in which to move. Then, according to the group decision as to how the moves are counted, the player moves his or her said car-playing-piece from its place, being either said Home Base, a said colored road section, or a Geographic Place, 10, either across four said colored road sections to a fifth colored road section, or across as many colored road sections as he or she can move while five seconds are counted out, as one-thousand-one through one-thousand-five. On the final colored road section allotted, the player stops and waits until his or her next turn.

Red: Before beginning, the group decides whether the red side on top, 43, means either "stop" or "rest stop." By throwing the said cube's red side up on top, the player has a stop traffic-signal. If designated "stop," the player remains in place, waiting for his or her next turn. If designated "rest stop," the player goes to the said nearby Geographic Place, 10, of the same number and color of the colored road section upon which he or she was stopped, and, then, waits at the said Geographic Place until, on a turn, he or she gets a green to return to the same road section.

Yellow: By throwing a yellow side up on top of the cube, 42, the player has a caution traffic signal and gets to throw again.

White: By throwing a white side up on top of the cube, 41, said white side having a black letter T meaning treasure or treat, the player chooses a said Geographic Place, 10, anywhere on the board, and states the reason he or she wishes to go there, the reason being a specific treasure or treat he or she will find there. The player puts a silver bonus disk, 63, on the said Geographic Place. After arriving at his or her chosen Geographic Place in as many turns as are needed, the player picks up the said silver disk and gets the bonus of five more moves of counted spaces, or five more counted seconds to move, added onto any allotted moves or time not yet used and continues on his or her route.

Method 2, Using the Traffic-Situations' Questions and Answers of FIG. 15

Using the Traffic-Situations' Questions and Answers determines the number of moves in colored road sections or the number of seconds to move in the advanced players' form of the game, said form called the DD!, Defensive Driving Game, a game of skill and knowledge of safe driving procedures. These questions and answers may be on cards, as portrayed in FIG. 15, or in programmed learning books, slides, audio or video cassettes, television programs, or computer discs. In the thirty-six categories involving over two thousand driving situations of questions and answers, the players learn and/or communicate their knowledge of the vast range of driving skills and knowledge. The players choose one set of traffic situations for each game, which set may be one category or may be a combination of situations from several or all categories, the title card for one category being portrayed, 88. The group decides whether the car-playing-piece will be moved according to five colored road sections in one move or according to the distance that can be covered in five seconds on one move. The steps of Method 2 follow:

Reading the Question, 93: Each player either takes or is dealt two cards from a stack of cards. On his or her turn, a player chooses to read one of the cards and places the other card back in the pack, on the bottom. If the group prefers, a designated person may read all the questions and not participate as a player. In that case, the non-player reader is the only one to handle the cards.

Calling DD!: Any player first to call out "DD!" gets to answer, in his or her own words, the question. Calling "DD!" emphasizes that quick reaction, shown by the player quickly responding to the situation, is an essential aspect of safe driving. One state's solution suffices.

Challenging: Any other player can challenge the answer called out by then also calling out "DD!" and giving another answer.

Reading the Answer, 97: The answer, being the solution to the situation based on the driving manuals of the fifty states of the United States, is read aloud by the person who read the question. If other forms of questions and answers besides cards are used, such as the programmed learning books or computer disks, the methods of presenting questions and answers are adapted to such forms. If no player has called out "DD!", the solution is still read before the next turn.

Agreeing on the Answer: The majority of the group decides on the correctness of a player's answer according to the answer read aloud.

Moving the Car-Playing-Piece: If the other players cannot answer the question correctly, the player-reader gets to move his or her car-playing-piece, FIG. 6, ahead on said game board either by said five colored road sections, 6 or 8, or by said distance covered in five seconds. When a player's DD! response is correct, he or she so moves his or her car-playing-piece. A non-player designated reader moves no car.

Marking Penalty: Upon giving an incorrect answer, the player must record one penalty point on his Records Wheel, FIG. 13, Penalty Card, 80.

Taking the Next Turn: After each question and answer, the player to the left of the previous player-reader, in sequence of turns, or the designated, non-player reader reads the next question, and the above procedure is followed.

Receiving the DD! Award: After giving five correct answers, the player gets a DD! Award of a gold disk, FIG. 12, 58, with the potential of extra moves, either across five colored road sections or across the distance one can travel in five seconds. As in Method 1, the U.S. Grand Prix Game, the player chooses a Geographic Place on which he or she can claim the said award, stating the reason he or she wishes to go to that particular Geographic Place, 10, and places there a gold disk, FIG. 12, 58. Then, the player takes the five moves he or she had earned from getting the fifth correct answer. After the player gets to the said chosen Geographic Place in as many turns as needed, he or she picks up the gold disk and claims his award of five moves or seconds and makes them, plus any other moves or seconds he or she may still have, continuing on his or her route.

SAFE DRIVING RULES FOR MOVING ON THE SAID BOARD: These rules apply with any methods of moving the said car-playing-pieces, as follows:

Rule 1, Following One's Route: The player must follow his or her route card in the direction of the arrows on the board. If he gets off his route, he must get back on it by using his allotted moves.

Rule 2, Passing: The player's car may pass other cars on either the said U.S. Routes or the said Interstate Highway by using a lane on which there is no other car in the way ahead. If both lanes ahead are being used by other cars, the player's car must wait on the Colored Road Section it had reached. The player then records on the Wait Card, 72, of the Records Wheel, FIG. 13, the number of moves or the number of seconds to which he or she is entitled but is blocked from making. On a subsequent turn, when a lane is clear, the player moves his or her car-playing-piece ahead the number of moves or seconds allotted on the later turn, plus the recorded Wait moves or seconds. When all Waits are used, the player turns the said Wait Card back to zero.

Rule 3, Going the Right Way: Going the wrong way against the arrows, 4, is a traffic violation. The player must immediately solve the problem either by backing up the car or by turning the car around by going to the nearest town or resort, 10, and waiting there until his or her next turn.

Rule 4, Observing the speed limit: The player must keep his car-playing-piece on the road, being the travel pathways. Speeding by lifting or flying one's car is a traffic violation.

Rule 5, Stopping at marked stops, 18: The player must make a definite stop of his car-playing-piece at every marked stop, before proceeding further on his turn. Not stopping at marked stops is a traffic violation.

Rule 6, Observing Yield Signs: The player must stop his car-playing piece at a yield sign, 19, when there is another car coming in the colored road section immediately before the said yield sign. Not yielding is a traffic violation.

Rule 7, Using The Traffic Lanes Correctly: A player's car-playing-piece must travel in the lane on the right, if that lane is clear of other car-playing-pieces. On U.S. Routes, the player must move the car-playing-piece to the left lane if the right lane is occupied by another car-playing-piece. On the Interstate Highway, the player must move the said car to the left lane, if another car wishes to enter the Interstate through an entrance ramp. Misuse of a traffic lane is a traffic violation, which also includes weaving, crossing solid yellow or black lines, or black or white diagonal lines, or being in the wrong lane for a turn or for driving.

Rule 8, Avoiding hitting other cars or highway objects, such as bridges, 25: The player must drive with care. To hit anything is a traffic violation.

Rule 9, Keeping Intersections Clear: Blocking an intersection is a traffic violation.

VIOLATIONS: When seeing any violation of the above traffic rules, any player may call out "Violation!" Then, the player making the violation must remain in the colored road section where the violation was called, and he or she loses the rest of his or her moves or time on that turn. The player must correct the error on the road to get the car-playing-piece out of the way of other traffic. For each violation, the player must record one penalty point on the Penalty Card, 80, of the said Records Wheel, FIG. 13. More than one violation may occur at the same time, and each violation incurs one penalty point to be recorded.

Besides violations for using the board pathways incorrectly, another violation is that of giving an incorrect solution after calling out "DD!" in the traffic-situations' questions and answers method of playing the game. Said incorrect solution incurs one penalty point to be recorded.

LICENSE SUSPENDED: When the player has five penalty points recorded on the said Records Wheel, he or she must move his or her said car-playing-piece by following said arrows, 4, through the Grey Road Areas 7, 9, 11, and/or 15, to the nearby said Geographic Place, 10, identified by having the same number and color as the Colored Road Section he or she has just left. The player goes through the said Geographic Place, stopping at the stop sign, 18. The player turns in his or her license, FIG. 14, 86, and is out of the game for five turns He or she waits at the said Geographic Place and, after five turns, gets back his or her license. The upon getting any allotted moves or seconds, he or she returns to the said Colored Road Section he or she had left on the said U.S. Route or said Interstate Highway by following the said arrows, 4, through the said Grey Road Areas.

WINNING: The player who returns to his or her Home Base Finishing Point, 3, first is the winner and gets Pennant #1, FIG. 10, placed on the spool stand, FIG. 11, at his or her said Home Base. Each player is also a winner if he or she returns to Home Base on his or her next turn immediately following the last turn of the first winner, that is in the same round of turns. Thus, all players can be equal winners, in tying for first place, as all defensive drivers can be winners. Each winner also gets a Pennant #1 placed on the spool stand at his or her Home Base. The winners may also get a small American flag placed in the said spool stand. The game can be over at the first winner or the first round of winners, or it can continue until all players return to their Home Bases. In the latter case, as the other players come in on later turns, each gets a pennant numbered according to his or her order of return.

GOING TO A NEARBY GEOGRAPHIC PLACE: The player may be required or may choose to go to a nearby Geographic Place, 10, being a city, resort, or park, either to have a rest stop, page 32, to turn in one's license, page 36, to pick up a bonus, page 32, or an award, page 34, or to demonstrate's one's mastery of an interchange, pages 37 through 44.

If the player is on a U.S. Route, he or she leaves the Colored Road Section, 6, crosses the grey road area for entering or leaving the geographic places, 15, enters the proper entrance of the said Geographic Place, 10, stops before the stop sign, 18, and either continues on his or her route if having the moves or time to do so, or waits at the said geographic place until his or her next turn.

If the player is on the Interstate Highway, he or she exits from the Colored Road Section he or she is on, 8, by the nearest exit, either the west or east exit, 14, a grey road section ramp, 9, or an Interstate Exchange ramp, either 20, 21, or 22; crosses any grey road area between the Interstate and a U.S. Route, 11, the grey road section of the U.S. Route, 7, and the grey road area, 15, for entering and leaving the said Geographic Place; enters the proper entrance of the said Geographic Place; stops before the stop sign, 18; and either continues on his or her route, if having the moves or seconds to do so, or waits at the said Geographic Place until his or her next turn.

On being permitted to leave the said Geographic Place, the player returns to a particular Colored Road Section of the U.S. Route or of the Interstate Highway, according to the requirements of the reason for going to the said Geographic Place, being either the rest stop, page 32, the license suspended, page 36, the bonus, page 32, the award, page 34, or the demonstration of the mastering of an interchanges, pages 37 through 44

USING THE INTERCHANGES: A player may show his or her mastery of an Interchange, a requirement in the advanced players' form of the game, page 30, by using a bridge, 25, to cross the Interstate Highway and go to a Geographic Place, 10, on the opposite side of the board. The player chooses the particular Geographic Place, in the vicinity of his or her car-playing-piece, to which to go and states the reason he or she wants to go there, such as seeing the sights.

The player may also use some of the interchange ramps, 20, 21, and 22, as told on page 30, to eliminate some miles of Colored Road Sections by getting off the Interstate and then, by using immediately the next nearest ramp, to get back on the Interstate.

The player may also use some of the said interchange ramps to go to a said Geographic Place on the same side of the board in order to get a bonus, award, or rest stop or to turn in one's license, as discussed above in Going to a Nearby Geographic Place, pages 36 and 37.

When moves are counted by number of Colored Road Sections, one such move is between the Colored Road Section of the Interstate and the Geographic Place. When moves are counted by seconds, the player takes his or her car-playing-piece as far as possible in the seconds allotted.

The following descriptions of the ways to use the individual interchanges refer to the bridges, 25, interchanges, 20, 21, and 22, and the pathways, 6, 7, and 15, lying beyond the Interstate, shown on FIGS. 1, 2, and 3.

Using the Folded Diamond Interchange of FIGS. 1 and 2:

Traveling west, the player may use the Folded Diamond Interchange, 20, to cross over the Interstate Highway to the opposite side of the board, being the southwest, by the bridge, 25, crossing to go to the chosen Geographic Place, 10, either NASA, Carlsbad Caverns, or the Grand Canyon. To use the said Interchange after the player reaches the Colored Road Section #20 on the Interstate, 8, he or she exits to the right on the Folded Diamond ramp, 20, makes a right turn to enter the bridge road, 24, on the north of the Interstate, crosses the said bridge, 25, going to the south, goes straight ahead to cross the bridge road on the south of the Interstate, 24, and exits on the U.S. Route Grey Road Section, 7, crosses said Grey Road Section and also Grey Road Area for entering and leaving the Geographic Places, 15, continues on to the chosen southwestern Geographic Place, enters the place properly, following the arrows, 4, and stops at the stop sign, 18. To return to the Interstate Highway from the said southwestern Geographic Place, the player recrosses both the Grey Road Area, 15, and the said Grey Road section, 7, reenters the bridge road, 24, south of the Interstate, recrosses said bridge, 25, makes a left turn on the bridge road, 24, north of the Interstate, enters the Folded Diamond ramp, 20, and reenters the Interstate Highway at Colored Road Section #21A, 8.

Traveling east, the player may use the Folded Diamond Interchange to cross over the said Interstate Highway to the opposite side of the board, being the northwest, by said bridge, 25, to go to his or her chosen Geographic Place, 10, either Mt. Rainier, Yellowstone National Park, or Mt. Rushmore. To use the said Interchange after the player reaches the Colored Road Section #1A on the Interstate, 8, he or she exits to the right on the Folded Diamond ramp, 20, crosses the bridge road, 24, south of the Interstate, crosses said bridge, 25, exits on the U.S. Route Grey Road Section, 7, north of the Interstate, crosses the Grey Road Area, 15, continues on to the chosen northwestern Geographic Place, enters the said Place properly, following the arrows, 4, and stops at the stop sign. To return to the Interstate Highway from the Northwestern Geographic Place, the player recrosses both the Grey Road Area, 15, and the said Grey Road Section, 7, reenters the bridge road, 24, north of the Interstate, recrosses said bridge, 25, enters the bridge road south of the Interstate, makes a right turn into the Folded Diamond ramp, 20, and reenters the Interstate Highway at Colored Road Section #3.

The player may use the Folded Diamond Interchange to go to a Geographic Place, 10, on the same side of the board. Going west after reaching Colored Road Section #20, on the Interstate, 8, the player makes a right turn to enter the Folded Diamond ramp, 20, turns right again to enter the bridge road, 24, north of the Interstate, crosses the bridge, 25, turns left at the bridge road south of the Interstate, 24, recrosses the said bridge and the bridge road, 24, north of the Interstate, exits on the U.S. Route Grey Road Section, 7, crosses said Grey Road section and also Grey Road Area for entering and leaving the Geographic Places, 15, continues on to the chosen northwestern Geographic Place, enters the place properly, following the arrows, 4, and stops at the stop sign, 18. To return to the Interstate Highway from the said northwestern Geographic Place, the player recrosses both the Grey Road Area, 15, and the said Grey Road Section, 7, reenters the bridge road north of the Interstate, enters the Folded Diamond ramp, 20, and reenters the Interstate Highway at Colored Road Section #21A, 8.

In using the Folded Diamond Interchange to go to a Geographic place, 10, on the same side of the board, while going east, the player exits after reaching Colored Road Section #A, on the Interstate, 8. The player makes a right turn to enter the Folded Diamond ramp, 20, enters the bridge road, 24, south of the Interstate, turns right and exits onto U.S. Route Grey Road Section, 7, crossing it, crosses Grey Road area between the U.S. Route and the Geographic Places, 15, continues on to the chosen southwestern Geographic Place, enters the place properly, following the arrows, 4, and stops at the stop sign, 18. To return to the Interstate Highway from the said southwestern Geographic Place, the player recrosses both said Grey Road Area, 15, and said Grey Road Section, 7, reenters the bridge area south of the Interstate, 24, turns left to enter the Folded Diamond ramp, 20, and reenters the Interstate Highway at Colored Road Section #3, 8.

The players cannot use the Folded Diamond ramps to eliminate certain Colored Road Sections on the Interstate in order to gain time or space in traveling.

Using the Cloverleaf Interchange of FIG. 2:

Traveling west, the player may use the Cloverleaf Interchange to cross over the Interstate Highway to the opposite side of the board, being the southcentral United States, by the bridge, 25, to go to his or her chosen Geographic Place, 10, either Dallas, New Orleans, or Mobile. To use the said Interchange after the player reaches the Colored Road Section #16 on the Interstate, 8. he or she exits to the right on the Cloverleaf ramp, 21, crosses the north lane of the bridge road, 24, on the north of the Interstate, makes a left turn to get onto the said bridge, crosses the bridge going to the south, goes straight ahead to cross the bridge road on the south of the Interstate, 24, and exits on the U.S. Route Grey Road Section, 7, crosses said Grey Road Section and also the Grey Road Area For Entering and Leaving the Geographic Places, 15, continues on to the chosen southcentral Geographic Place, enters the Place properly, following the directional arrows, 4, and stops at the stop sign, 18. To return to the Interstate Highway from the said southcentral Geographic Place, the player recrosses both the said Grey Road Area, 15, and the said Grey Road Section, 7, reenters the bridge road, 24, south of the Interstate, recrosses the said bridge, 25, makes a right turn from the bridge road, 24, north of the Interstate, enters the Cloverleaf ramp, 21, and reenters the Interstate Highway at Colored Road Section #17.

Traveling east, the player may use the Cloverleaf Interchange to cross over said Interstate Highway to the opposite side of the board, being the northcentral United States, by the bridge, 25, to go to his or her chosen Geographic Place, 10, either Des Moines, Chicago, or Detroit. To use the said Interchange after the player reaches the Colored Road Section #4 on the Interstate, 8, he or she exits to the right on the Cloverleaf ramp, 21, crosses the bridge road, 24, south of the Interstate, turns left to get on the said bridge, crosses the said bridge, crosses the bridge road, 24, north of the Interstate, goes straight ahead to exit on U.S. Route Grey Road Section, 7, crosses said Grey Road Section and also the Grey Road Area for Entering and Leaving the Geographic Places, 15, continues on to the chosen northcentral Geographic Place, enters the Place properly, following the directional arrows, 4, and stops at the stop sign, 18. To return to the Interstate Highway from the said northcentral Geographic Place, the player recrosses both the said Grey Road Area, 15, and the said Grey Road Section, 7, reenters the bridge road, 24, north of the Interstate, recrosses the said bridge, 25, enters the bridge road, south of the Interstate, 24, makes a left turn into the Cloverleaf ramp, 21, and reenters the Interstate Highway at Colored Road Section #8.

The player may use the Cloverleaf Interchange to go to a Geographic Place, 10, on the same side of the board, either Des Moines, Chicago, or Detroit. Going west after reaching Colored Road Section #16 on the Interstate, 8, the player makes a right turn onto the Cloverleaf ramp, 21, goes straight ahead onto U.S. Route Grey Road Section, 7, crosses it and crosses Grey Road Area for Entering and Leaving Geographic Places, 15, enters the Geographic Place properly, following the arrows, 4, and stops at the stop sign, 18. To return to the Interstate Highway from the said northcentral Geographic Place, the player recrosses both the Grey Road Area, 15, and the Grey Road Section, 7, west of U.S. Route Road Section #18, enters the Cloverleaf ramp, 21, west of the bridge road, 24, observes the yield sign, 19, and reenters the Interstate at Colored Road Section #19, 8.

The player may use the Cloverleaf Interchange to go to a southcentral Geographic Place on the same side of the board, either Dallas, New Orleans, or Mobile, when going east. After reaching Colored Road Section #4, the player makes a right turn onto the Cloverleaf ramp, 21, enters the bridge road, 24, stops at the stop sign, 18, crosses U.S. Route Grey Road section, 7 and the Grey Road Area, 15, continues on to the chosen southcentral Geographic Place, 10, enters the place properly, following the arrows, 4, and stops at the stop sign, 18. To return to the Interstate Highway from the said southcentral Geographic Place, the player recrosses both said Grey Road Area, 15, and said Grey Road Section, 7, reenters the bridge road south of the Interstate, 24, turns right to enter the Cloverleaf ramp, 21, east of the said bridge road, and reenters the Interstate Highway at Colored Road Section #8, 8.

The player may use the Cloverleaf ramps to eliminate certain Colored Road Sections on the Interstate in order to gain time or space in traveling. To do this, the player going west after reaching Colored Road Section #16 on the Interstate, 8, makes a right turn onto the Cloverleaf ramp, 21, then turns left on the said ramp, crosses the bridge road, 24, enters the Cloverleaf ramp, west of the said bridge road, follows the arrows, observes the yield sign, 19, and enters the Interstate at Colored Road Section #19, 8. This maneuver eliminates crossing Colored Road Sections #17 and #18.

To use the Cloverleaf ramp to eliminate certain Colored Road Sections on the Interstate in order to gain time or space in traveling, the player going east after reaching Colored Road Section #4 on the Interstate, 8, makes a right turn onto the Cloverleaf ramp, 21, crosses the bridge road, 24, enters the Cloverleaf ramp, 21, east of the said bridge road, and reenters the Interstate Highway at Colored Road Section #8, 8. This maneuver eliminates crossing Colored Road Sections #5, #6, and #7.

Using the Trumpet Interchange of FIGS. 2, 3, and 4:

On FIG. 4, over the Trumpet Interchange is shown the bridge, 25, lying flat on top of the interchange before it is placed in the slots, 23, and pulled into its 3-dimensional curve. Therefore, the examiner needs to refer to FIGS. 2 and 3 to see the bridge road, 24, hidden by the full length of the bridge in this particular drawing of FIG. 4 and also to see the connection of the Trumpet ramps, 22, to the said bridge road.

On FIGS. 2 and 3, traveling west, the player may use the Trumpet Interchange to cross over the Interstate Highway to the opposite side of the board, being the southeastern United States, by the bridge, 25, to go to his or her chosen Geographic Place, 10, either Tampa, Disney World, or Cape Canaveral. To use the said Interchange after the player reaches the Colored Road Section #13, on the Interstate, 8, he or she exits to the right on the Trumpet ramp, 22, stops at the stop sign, 18, crosses the northbound lane of the bridge road, 24, makes a left turn to enter the southbound lane of the bridge road, 24, on the north of the Interstate, crosses the bridge, 25, going to the south, goes straight ahead to cross the bridge road, 24, on the south of the Interstate, and exits on the U.S. Route Grey Road Section, 7, crosses said Grey Road Section and also the Grey Road Area for Entering and Leaving Geographic Places, 15, continues on to the chosen southeastern Geographic Place, enters the place properly, following the directional arrows, 4, and stops at the stop sign, 18. To return to the Interstate Highway from the said southeastern Geographic Place, the player crosses Grey Road Area, 15, Grey Road Section, 7, and U.S. Route Colored Road Section #9, reenters the bridge road, 24, south of the Interstate, recrosses the said bridge, 25, stops at the stop sign, 18, makes a left turn to cross the southbound lane of the bridge road north of the Interstate, enters the Trumpet ramp, 22, west of the said bridge road, and reenters the Interstate Highway at Colored Road Section #16, 8.

Traveling east, the player may use the Trumpet Interchange to cross over said Interstate Highway to the opposite side of the board, being the northeastern United States, to go to his or her chosen Geographic Place, 10, either Cedar Point, Cleveland, or Niagara Falls. To use the said Interchange after the player reaches the Colored Road Section #9 on the Interstate, 8, he or she exits to the right on the Trumpet ramp, 22, observes the yield sign, makes a right turn onto the bridge road, 24, south of the Interstate, crosses the bridge, 25, enters the bridge road north of the Interstate, 24, stops at both stop signs, 18, exits onto U.S. Route Grey Road Section, 7, crosses said Grey Road Section, and also the Grey Road Area for Entering and Leaving the Geographic Places, 15, continues on to the chosen Geographic Place, enters said Place properly, following the arrows, 4, and stops at the stop sign, 18.

To return to the Interstate Highway from the northeastern Geographic Place, the player recrosses both said Grey Road Area, 15, and said U.S. Route Grey Road Section, 7, reenters the bridge road north of the Interstate, recrosses said bridge, 25, enters the bridge-road south of the Interstate, 24, makes a left turn to cross over from the said bridge road onto the Trumpet ramp, 22, east of the said bridge road, and reenters the Interstate Highway at Colored Road Section #10A.

The player may use the Trumpet Interchange to go to a Geographic Place, 10, on the same side of the board. Going west after reaching Colored Road Section #13, on the Interstate, 8, the player makes a right turn to enter the Trumpet ramp, 22, stops at the stop sign, 18, turn right onto bridge road, 24, north of the Interstate, observes the stop sign, 18, exits onto U.S. Route Grey Road section, 7, crosses said Grey Road Section and also the Grey Road Area for Entering and Leaving the Geographic Places, 15, continues on to the chosen Geographic Place, enters said Place properly, following the arrows, 4, and stops at the stop sign, 18. To return to the Interstate Highway from the said northeastern Geographic Place, the player recrosses both said Grey Road Area, 15, and said U.S. Route Grey Road Section, 7, reenters the bridge road north of the Interstate, 24, makes a right turn onto Trumpet ramp, 22, west of the said bridge road, and reenters the Interstate at Colored Road Section #16, 8.

In using the Trumpet Interchange to go to a southeastern Geographic Place, being on the same side of the board, either Tampa, Disney World, or Cape Canaveral, after reaching Colored Road Section #9 on the Interstate, 8, the player traveling east exits to the right on the Trumpet ramp, 22, observes the yield sign, crosses the bridge road, 24, south of the Interstate, makes a left turn onto the said bridge road going south, and stops at the stop sign, 18. He or she crosses U.S. Route Grey Road Section, 7, and, also, Grey Road area, 15, continues on to the chosen Geographic Place, enters said Place properly, following the arrows, 4, and stops at the stop sign, 18.

To return to the Interstate Highway from the southeastern Geographic Place, the player crosses Grey Road Area, 15, Grey Road section, 7, and U.S. Route Colored Road section #9, 8, reenters the bridge road, 24, south of the Interstate, turns right onto the Trumpet ramp, 22, east of the said bridge road, and reenters the Interstate Highway at Colored Road Section #10A, 8.

The player may use the Trumpet ramps to eliminate certain Colored Road Sections on the Interstate in order to gain time or space in traveling. To do this in going west, after the player reaches the Colored Road Section #13 on the Interstate, 8, he or she exits to the right on the Trumpet ramp, 22 north of the Interstate, stops at the stop sign, 18, crosses the bridge road, 24, and enters the Trumpet ramp, 22, west of the said bridge road. He or she observes the yield sign and reenters the Interstate at Colored Road Section #16, 8. This maneuver eliminates crossing Colored Road Sections #14 and #15.

In going east, the player may not use the Trumpet ramps to eliminate certain Colored Road Sections on the Interstate in order to gain time or space in traveling.

USING OTHER FIGURES, OTHER VEHICLES, AND EXTENSIONS ON THE BOARD:

To give a variety of experiences, players may place figures and vehicles on the board, such as emergency vehicles, animals, people, and traffic apparatus, such as railroad crossings and traffic lights, none of which are shown. These objects may be toys or may be constructed by the players out of cardboard. There may be extensions of other kinds of interchanges, road circles, and particular highways of geographic places.

USING THE BOARD AS PLAYING TRACKS FOR TOY CARS: The road sections of the large-size and the medium-size boards are the sizes that can accomodate the appropriate sizes of toy cars that many children have. Thus, children can play on the board, making up their own play.

THE METHOD OF PLAYING THE GAME ON THE BOARD COVER OF FIG. 5

An easy form of the game, for beginners, children, or any players, called the Wheel of States Game, can be played on the map of the United States, 28, on the cover, FIG. 5, of the U.S. Cross Country Highway game board of FIGS. 1, 2, and 3, by moving the car-playing piece of FIG. 6 from state to state, FIG. 5, 30, the said states being pathways, as follows:

PLACING THE BLUE STARRED DISK, FIG. 12, 68: The players place one said blue starred disk on each state, 30, of the said map of the United States of FIG. 5. Since both sides of a said disk have a painted white star, 70, either side may be up.

STARTING: The players throw the traffic-light cube, FIG. 8, to determine who first gets the green side up and thus goes first as the starting player. The said starting player selects a car-playing-piece, FIG. 6, after which each player, in turn, to the left, selects a said car-playing-piece.* Each player, in turn, spins the spinner, FIG. 7, on the reverse side, 38, which said side has the names of the fifty states of the United States, 31, in a colored area, 39, which matches in color that of the states, 30, on the cover of the board, FIG. 5. Said reverse side of the said spinner is called the Wheel of States, giving this form of the game its name. The individual state area, 39, to which the metal key, 36, called a car key, points, is the name of the state, FIG. 5, 31, upon which the player places his or her said car-playing-piece on which to start. If the point of the metal key ends on a line, the player takes the name of the state to the left. After each player has placed his or her car-playing-piece on the assigned state, each player, in turn, spins again to get the name of the state to which to travel, names the state aloud, and perhaps the capitol, and tells why he or she wishes to go there by naming something or someone to see, such as a park, industry, agriculture, relative, or other similar reason.

*Note: On the large 33-inch-wide game board, the players use 1 and 11/16 inches long cars; on the medium-size 16½-inches-wide board and on the small 11-inches-wide game board, the players use 1 inch long cars.

USING THE CUBE, FIG. 8, TO GET ONE'S MOVES: Each player, in turn, throws the said cube to get one's moves according to the color that comes up on top.

Green, 44, means three moves by going across three states to one's spinner-assigned state, without crossing any state twice on the said three moves.

Red, 43, means that the player cannot move.

Yellow, 42, means that the player throws again.

T on White, 41, means that the player gets the treat of twice the number of moves, being six moves.

GETTING TO THE SPINNER-ASSIGNED STATE: If the player cannot get to the assigned state on one turn, he or she must wait on the state as far as one has gotten until the next turn. One gets to the assigned state in as many turns as it takes, but one does not spin again on each turn until one arrives at the assigned state.

PICKING UP THE BLUE STARRED DISK, FIG. 12, 68: When the player arrives at his spinner-assigned state, he or she picks up the said blue starred disk. If the player forgets to pick up the disk before leaving the state, he or she does not get it. The player must travel to the named state even if the disk has already been taken by another player on his or her journey.

TRAVELING TO ANOTHER STATE: After arriving at one spinner-assigned state, the player spins again to get a new state to which to travel. Each player continues, in turn, in going from state to state until all the disks are collected.

VIOLATIONS: Violations can occur by the player hitting another car with the car-playing-piece or making an error in moves, such as crossing the same state twice on one move. Also a violation is speeding, or lifting one's car. Said violations are recorded on the penalty card, 80, of the Records Wheel, FIG. 13. When another player calls "Violation!", the player making the violation must stop on the state where the violation occurred. On getting five violations, the player loses a turn, turns in his or her license, FIG. 14, 86, during the lost turn, and turns the said Penalty Card back to zero.

WINNING: The winner is the player who collects the most blue starred disks.

DECLARATION

Thus, it will be seen that we have provided a novel and highly educational and interesting game board and apparatus to enable the playing of a game of defensive driving of cars, giving hours of enjoyment to the players.

While we have illustrated and described several embodiments of our invention, it will be understood that these are by way of illustration only and that various changes and modifications may be contemplated in our invention and within the scope of the following claims:

We claim:

1. A board game apparatus comprising:

a game board, said game board comprising: a plurality of spaces representing geographic places positioned along the perimeter thereof, an outer continuous path representing highway routes concentrically located within the geographic spaces linking the geographic spaces, an inner pathway representing an interstate highway extending across the center of the board directly linking the routes on opposite sides of said board, said pathways being divided into lanes and road sections, said road sections each having directional arrows, a plurality of start and finish spaces along the perimeter thereof and each having unique indicia corresponding to its location, supplementary game board extension means comprising three separate interchange sections representing bridges which when placed on the board leads from the inner pathway to the outer pathway and the geographic places;

a secondary game board on the cover, being the reverse side of the main game board, said secondary game board comprising: a map of the United States with each state making a pathway from state to state;

a plurality of differently colored playing pieces for movement along the pathways of the main game board and the secondary game board;

a cube for determining the order of play and a cube container;

means determining each player's start positions comprising a spinner with an obverse side divided into a plurality of geographic areas, each area being defined by a unique indicia corresponding to the indicia on the start and finish spaces, and a reverse side divided into a plurality of fifty spaces representing the fifty states of the United States;

means determining the movement of the playing pieces comprising either a cube or a plurality of traffic problems and solutions, on cards, each card having a traffic problem on the obverse side and a solution to the problem on the reverse side, means designating a predetermined path each playing piece must follow comprising a plurality of cards each having instructions directing a player to take specific routes defining a predetermined path encircling the game board from a start to a finish, and a small map of the game board outlining said predetermined path;

means of an insurance policy card with a pledge for safe driving practices and a driver's license card which driver's license must be turned in for a number of violations of safe driving practices.

2. The board game of claim 1 further comprising a penalty recording means, a number of turns delayed recording means, and an award recording means, each including a first circular card having a plurality of numbers thereon and a second circular card rotatably mounted on top of said first card for covering said numbers, said second card having a notch therein for displaying one of said numbers.

3. The board game of claim 1 further comprising means designating awards and bonuses of a gold-colored disk, a silver-colored disk, and a blue disk with a painted white star.

4. The board game of claim 1 further comprising means designating the order of finish comprising a plurality of pennants, each pennant being numbered to correspond to the order of finish and a plurality of stands adapted to receive said pennants, said stands being color coded to match said playing pieces for identifying the order of finish of each player's playing piece.

* * * * *